US010561262B2

(12) United States Patent
Phan et al.

(10) Patent No.: US 10,561,262 B2
(45) Date of Patent: Feb. 18, 2020

(54) BEVERAGE CONTAINER WITH NON-MANUAL LID OPERATION

(71) Applicant: Pacific Market International, LLC, Seattle, WA (US)

(72) Inventors: Ping Phan, Shoreline, WA (US); Evan Michael Choltco-Devlin, Ellensburg, WA (US); Naiqiang Zhang, Seattle, WA (US); Mark Freeman, Seattle, WA (US); Scott Jarnagin, Seattle, WA (US)

(73) Assignee: Pacific Market International, LLC, Seattle, WA (US)

( * ) Notice: Subject to any disclaimer, the term of this patent is extended or adjusted under 35 U.S.C. 154(b) by 16 days.

(21) Appl. No.: 15/916,026

(22) Filed: Mar. 8, 2018

(65) Prior Publication Data

US 2018/0263392 A1 Sep. 20, 2018

Related U.S. Application Data

(60) Provisional application No. 62/471,888, filed on Mar. 15, 2017.

(51) Int. Cl.

| | |
|---|---|
| ***A47G 19/22*** | (2006.01) |
| ***B65D 43/02*** | (2006.01) |
| ***B65D 51/16*** | (2006.01) |

(52) U.S. Cl.

CPC ..... *A47G 19/2272* (2013.01); *B65D 43/0229* (2013.01); *B65D 51/1644* (2013.01); *B65D 2543/00046* (2013.01); *B65D 2543/0049* (2013.01); *B65D 2543/00092* (2013.01); *B65D 2543/00231* (2013.01)

(58) Field of Classification Search

CPC ..... A47G 19/2272; B65D 43/0229; B65D 51/1644; B65D 2543/00046; B65D 2543/00231; B65D 2543/0049; B65D 2543/00092

USPC ..... 222/52, 166, 164, 504

See application file for complete search history.

(56) References Cited

U.S. PATENT DOCUMENTS

| | | | | |
|---|---|---|---|---|
| 4,436,223 | A | 3/1984 | Wilson | |
| 6,036,055 | A * | 3/2000 | Mogadam | B67D 3/0006 222/23 |
| 8,127,954 | B2 | 3/2012 | Cano-Pey et al. | |

(Continued)

*Primary Examiner* — Donnell A Long

(74) *Attorney, Agent, or Firm* — Davis Wright Tremaine LLP; George C. Rondeau, Jr.; Heather M. Colburn

(57) ABSTRACT

A lid assembly configured to close an opening in a vessel holding a liquid. The lid assembly includes a drinking port, plunger member, and drive assembly. The plunger member is moveable between closed and open positions with respect to the drinking port. The plunger member prevents the liquid from flowing through the drinking port when the plunger member is in the closed position and allows the liquid to flow through the drinking port when the plunger member is in the open position. The drive assembly includes drive circuitry that automatically directs the drive assembly to move the plunger member to the open position when the drive circuitry detects the lid assembly is in a drinking position. The drive circuitry automatically directs the drive assembly to move the plunger member to the closed position when the drive circuitry detects the lid assembly is in other than the drinking position.

22 Claims, 15 Drawing Sheets

(56) References Cited

U.S. PATENT DOCUMENTS

| | | | | |
|---|---|---|---|---|
| 2001/0010316 | A1* | 8/2001 | Parsons | B67D 7/0238 222/52 |
| 2008/0195251 | A1* | 8/2008 | Milner | B67D 3/0035 700/237 |
| 2013/0075398 | A1* | 3/2013 | Morewitz, II | B65D 47/265 220/253 |
| 2014/0263430 | A1* | 9/2014 | Keating | B67D 3/0051 222/54 |
| 2015/0024349 | A1 | 1/2015 | Bischoff et al. | |
| 2015/0108026 | A1 | 4/2015 | Azimi et al. | |
| 2015/0122688 | A1* | 5/2015 | Dias | A47G 19/025 206/459.1 |
| 2015/0320265 | A1* | 11/2015 | Bullock | A47K 5/1217 222/1 |
| 2016/0025545 | A1 | 1/2016 | Saltzgiver et al. | |
| 2017/0188730 | A1 | 7/2017 | Schuller et al. | |
| 2017/0188731 | A1 | 7/2017 | Schuller et al. | |
| 2017/0238744 | A1* | 8/2017 | Sweeney | A47G 19/2227 |
| 2017/0340147 | A1* | 11/2017 | Hambrock | A47G 19/2227 |
| 2018/0305091 | A1* | 10/2018 | Krafft | A47G 19/2227 |
| 2018/0312321 | A1* | 11/2018 | Wondka | B65D 21/0206 |
| 2019/0053649 | A1* | 2/2019 | Novak | A47G 19/2272 |

* cited by examiner

BEVERAGE CONTAINER WITH NON-MANUAL LID OPERATION

CROSS REFERENCE TO RELATED APPLICATION(S)

This application claims the benefit of U.S. Provisional Application No. 62/471,888, filed on Mar. 15, 2017, which is incorporated herein by reference in its entirety.

BACKGROUND OF THE INVENTION

Field of the Invention

The present invention is directed generally to beverage containers.

BRIEF DESCRIPTION OF THE SEVERAL VIEWS OF THE DRAWING(S)

Like reference numerals have been used in the figures to identify like components.

DETAILED DESCRIPTION OF THE INVENTION

Figure 1:
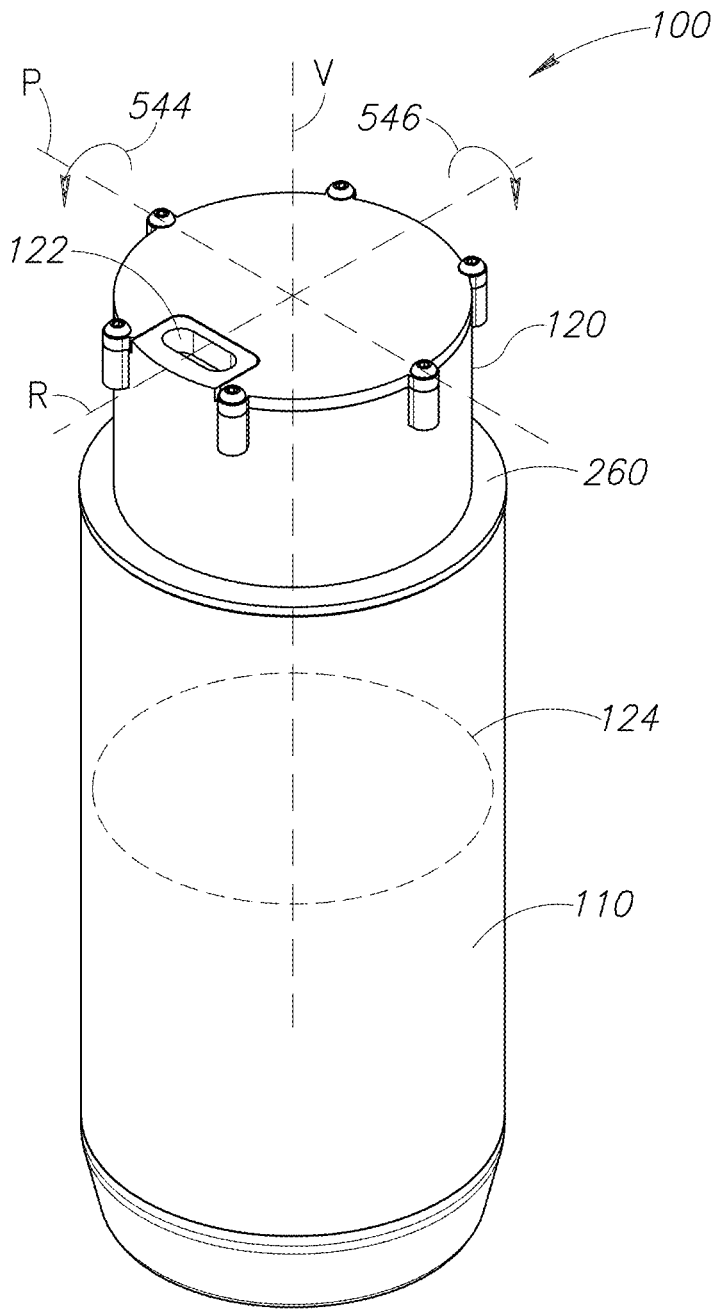
FIG. 1 is a perspective view of a beverage container having a lid assembly attached to a vessel.
Figure 2:
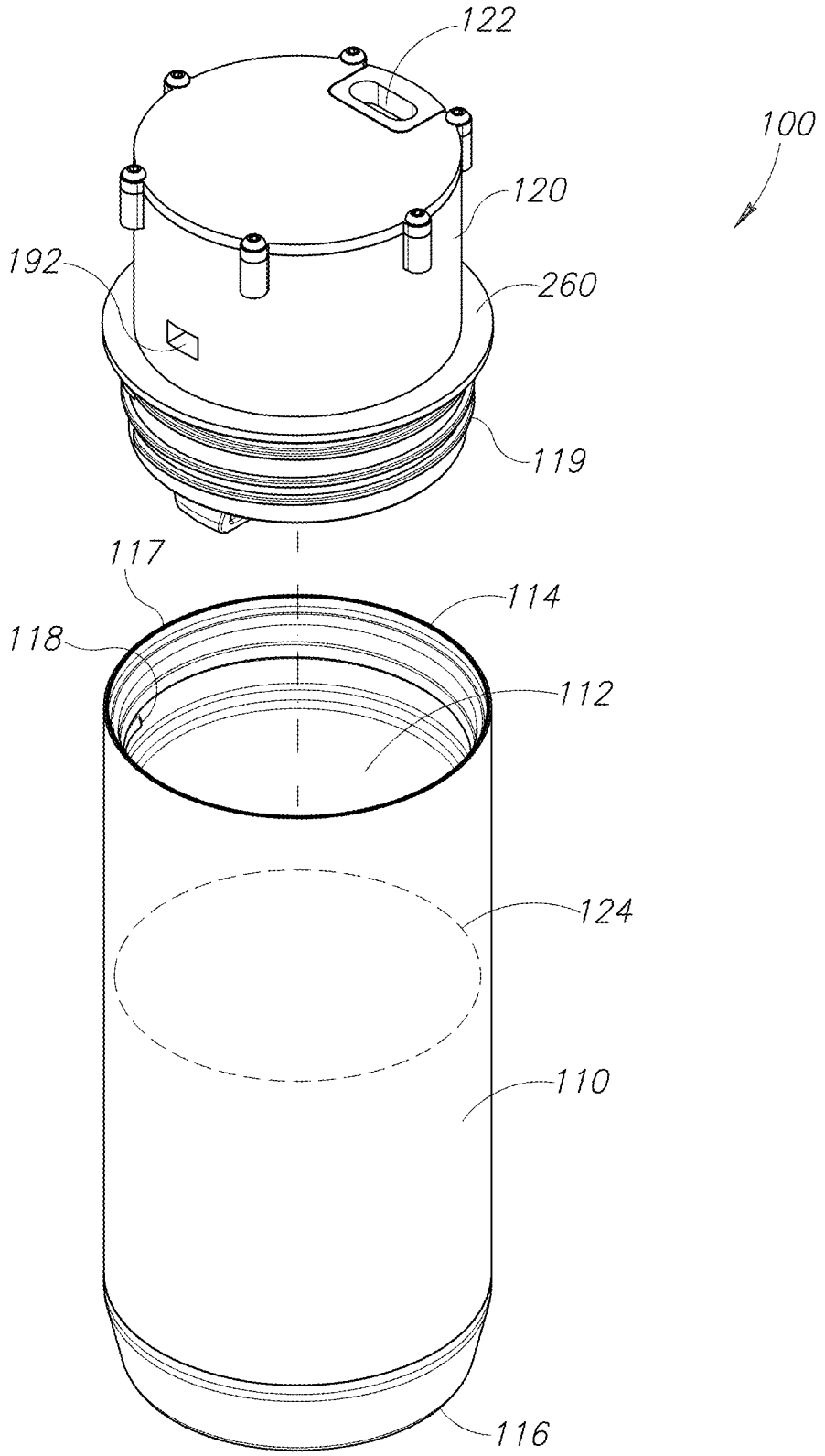
FIG. 2 is a perspective view of the beverage container of FIG. 1 illustrated with the lid assembly exploded from the vessel.

FIG. 1 depicts a beverage container 100 (e.g., a coffee mug) with a lid assembly 120 removably attached to a liquid tight cup-shaped vessel 110. Referring to FIG. 2, the vessel 110 defines a fluid tight hollow interior 112 configured to house a beverage or liquid 124. The vessel 110 has an open upper portion 114 opposite a closed base portion 116. The open upper portion 114 includes an opening 117 into the hollow interior 112. The liquid 124 may be poured into the hollow interior 112 of the vessel 110 via the opening 117. In the embodiment illustrated, the vessel 110 has inside threads 118 that extend into the hollow interior 112 along the open upper portion 114.

The lid assembly 120 is couplable to the open upper portion 114 to close the opening 117. In the embodiment illustrated, the lid assembly 120 has outside threads 119 configured to engage and mate with the inside threads 118 of the vessel 110. Thus, the user may selectively thread the lid assembly 120 onto and off the vessel 110. When the outside threads 119 are engaged with the inside threads 118, a liquid tight seal is formed therebetween.

Referring to FIG. 1, the lid assembly 120 is configured to open a drinking port 122 automatically to allow the liquid 124 housed inside the container 100 to flow therethrough. The lid assembly 120 is also configured to close the drinking port 122 automatically to prevent the liquid 124 from exiting the container 100 therethrough. As explained below, in the embodiment illustrated, the lid assembly 120 is configured to open the drinking port 122 when the user lifts and tilts the container 100 to drink. The lid assembly 120 is configured to close the drinking port 122 when the user places the container 100 in an upright position (illustrated in FIG. 1) in which the container 100 is substantially aligned along a vertical axis "V." Thus, as explained below, the drinking port 122 is opened and closed without much interaction from the user. The lid assembly 120 may also be configured to close the drinking port 122 when the user is walking briskly, running, has dropped the container 100 or the container 100 has fallen over. Optionally, the lid assembly 120 may include a lock out feature that prevents the drinking port 122 from opening (e.g., when the container 100 is operated by an unauthorized user).

Figure 5:
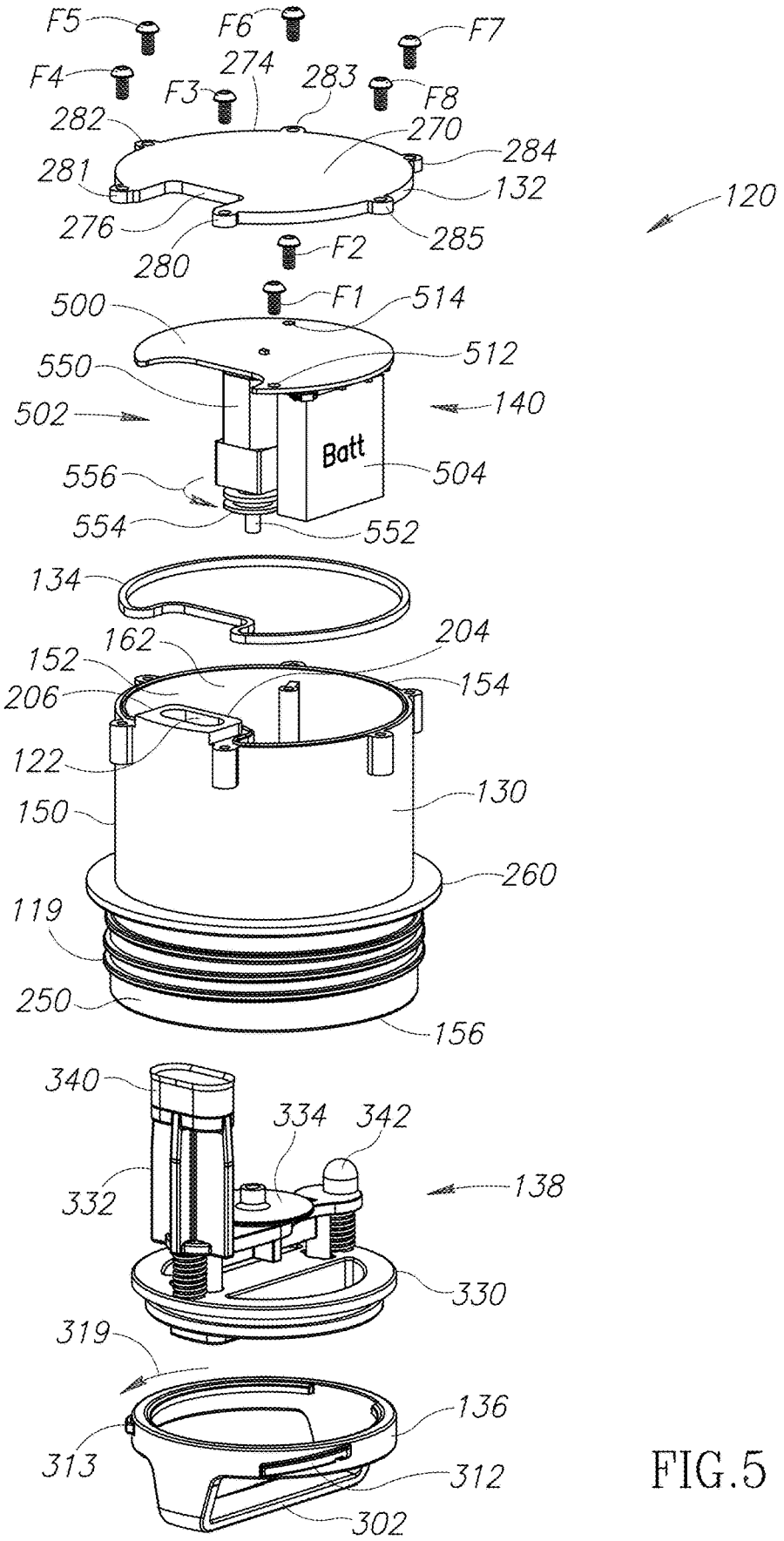
FIG. 5 is an exploded perspective view of the lid assembly of the beverage container of FIG. 1.

Referring to FIG. 5, the lid assembly 120 includes a lid body 130, a removable lid cover 132, an optional gasket or cover seal 134, a removable lid base 136, a plunger assembly 138, and a drive assembly 140.

Lid Body

Figure 8:
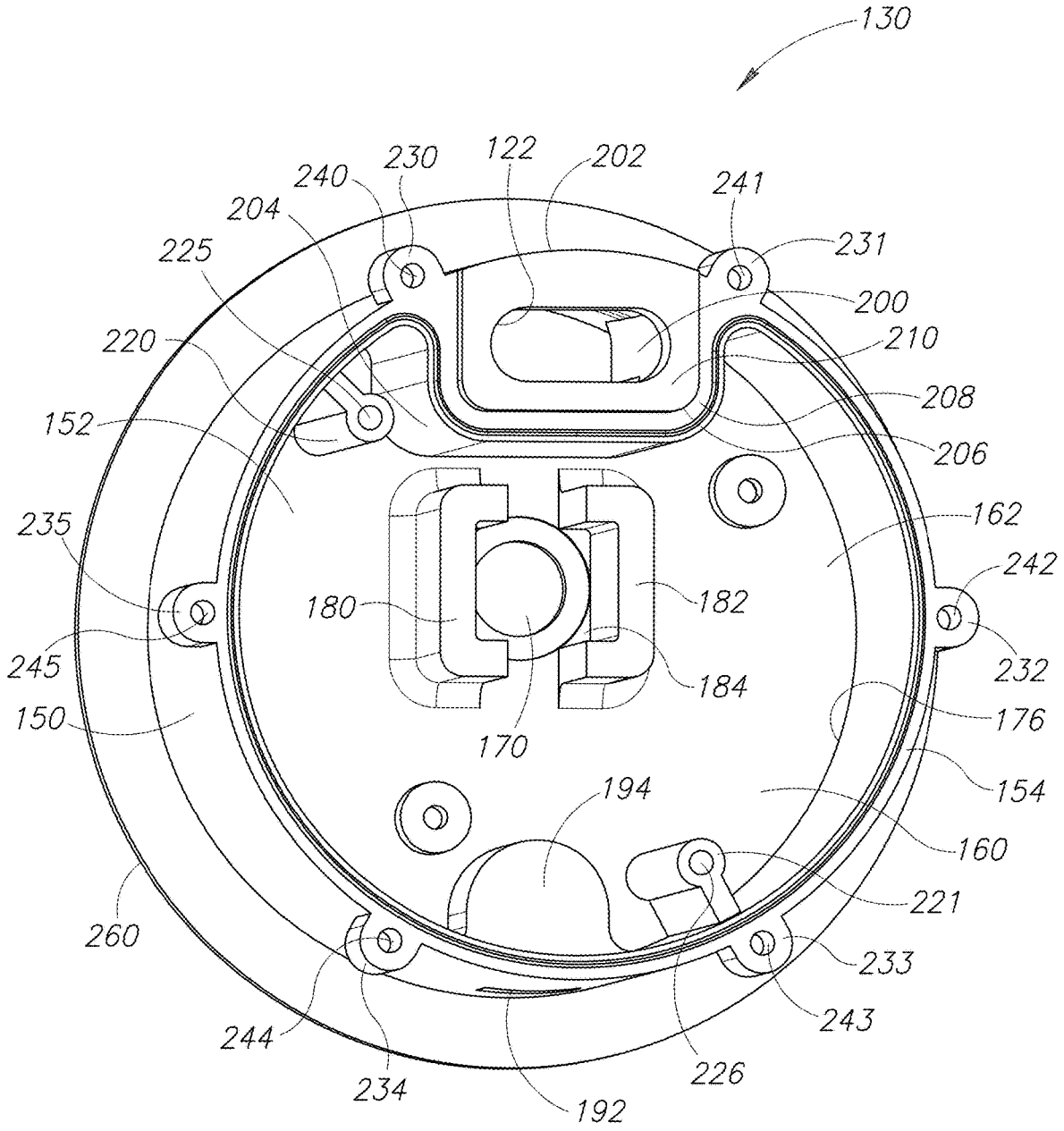
FIG. 8 is a top perspective view of a lid body of the lid assembly of FIG. 5.
Figure 9:
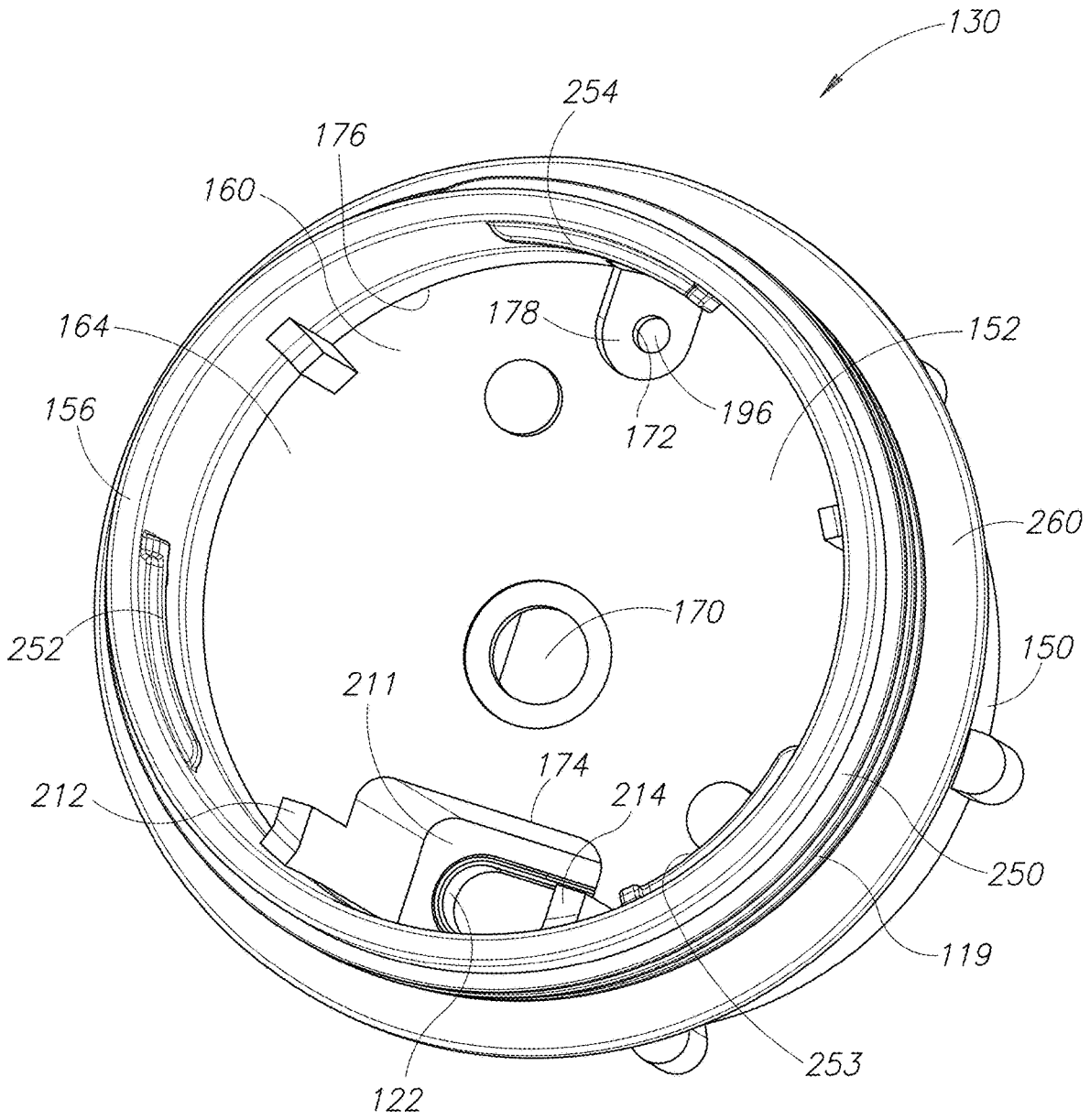
FIG. 9 is a bottom perspective view of the lid body of FIG. 8.

Referring to FIG. 5, the lid body 130 has an outer sidewall 150 defining a hollow interior 152. The outer sidewall 150 has an upper edge portion 154 opposite a lower edge portion 156. In the embodiment illustrated, the outer sidewall 150 has a generally cylindrical cross-sectional shape. Referring to FIGS. 8 and 9, a transverse platform 160 bifurcates the hollow interior 152 into an upper interior portion 162 (see FIG. 8) and a lower interior portion 164 (see FIG. 9). In the embodiment illustrated, a central through-hole 170 extends through the platform 160. Referring to FIG. 9, a vent through-hole 172 and a drink through-hole 174 are formed along a periphery 176 of the platform 160 and extend through the platform 160. In the embodiment illustrated, the vent through-hole 172 is positioned inside a recess 178 formed in the underside of the platform 160.

Referring to FIG. 8, a pair of spaced apart sidewalls 180 and 182 extend upwardly from the platform 160 along the central through-hole 170. An area 184 of the upper interior portion 162 is defined between the sidewalls 180 and 182.

Within the upper interior portion 162, the outer sidewall 150 of the lid body 130 has a vent aperture 192. A cover portion 194 of the lid body 130 encloses a vent through-channel 196 (see FIG. 9) that connects the vent aperture 192 to the vent through-hole 172 (see FIG. 9). Thus, when the vent through-hole 172 is unobstructed, air (e.g., steam) inside the lower interior portion 164 (see FIG. 9) may flow into the vent through-hole 172 (see FIG. 9), through the vent through-channel 196 (see FIG. 9), and out the vent aperture 192.

Referring to FIG. 8, an internal through-channel 200 connects the drink through-hole 174 (see FIG. 9) to the drinking port 122. The internal through-channel 200 is defined between a portion 202 of the outer sidewall 150 and an upwardly extending inner sidewall 204. In the embodiment illustrated, the portion 202 of the outer sidewall 150 and a distal portion 206 of the inner sidewall 204 both extend upwardly beyond the upper edge portion 154 of the outer sidewall 150. The inner sidewall 204 has a recessed portion 208 along the distal portion 206 (and near the drinking port 122) that is coplanar with the upper edge portion 154. The distal portion 206 has an upwardly facing surface 210 positioned above the recessed portion 208 along the vertical axis "V" (see FIG. 1) when the container 100 is in the upright position illustrated in FIG. 1. Referring to FIG. 9, the distal portion 206 also has an inwardly and downwardly facing surface 211 opposite the upwardly facing surface 210 (see FIG. 8).

Referring to FIG. 9, inside the lower interior portion 164, a pair of sidewalls 212 and 214 flank the drink through-hole 174. The sidewalls 212 and 214 extend inwardly from the outer sidewall 150 and downwardly toward the lower edge portion 156 of the outer sidewall 150.

Referring to FIG. 8, mounting structures 220 and 221 extend upwardly from the platform 160. In the embodiment illustrated, the mounting structures 220 and 221 include apertures 225 and 226, respectively, configured to receive fasteners F1 and F2 (see FIG. 5), respectively.

Mounting structures 230-235 may extend radially outwardly from the outer sidewall 150 along the upper edge portion 154 of the outer sidewall 150. In the embodiment illustrated, the mounting structures 230-235 include apertures 240-245, respectively, configured to receive fasteners F3-F8 (see FIG. 5), respectively.

Referring to FIG. 5, the outside threads 119 may extend along a lower portion 250 of the outer sidewall 150. Referring to FIG. 9, inside the lower interior portion 164, the lid body 130 may include one or more inwardly extending connector projections 252-254. As may be seen in FIG. 15, each of the inwardly extending connector projections 252-254 includes an upwardly extending tab 256.

Referring to FIG. 5, an annularly shaped flange 260 extends radially outwardly from the outer sidewall 150. The flange 260 is positioned above the outside threads 119. Referring to FIGS. 1 and 2, the flange 260 abuts the open upper portion 114 (see FIG. 2) of the vessel 110 when the lid assembly 120 is coupled to the vessel 110.

Lid Cover

Figure 15:
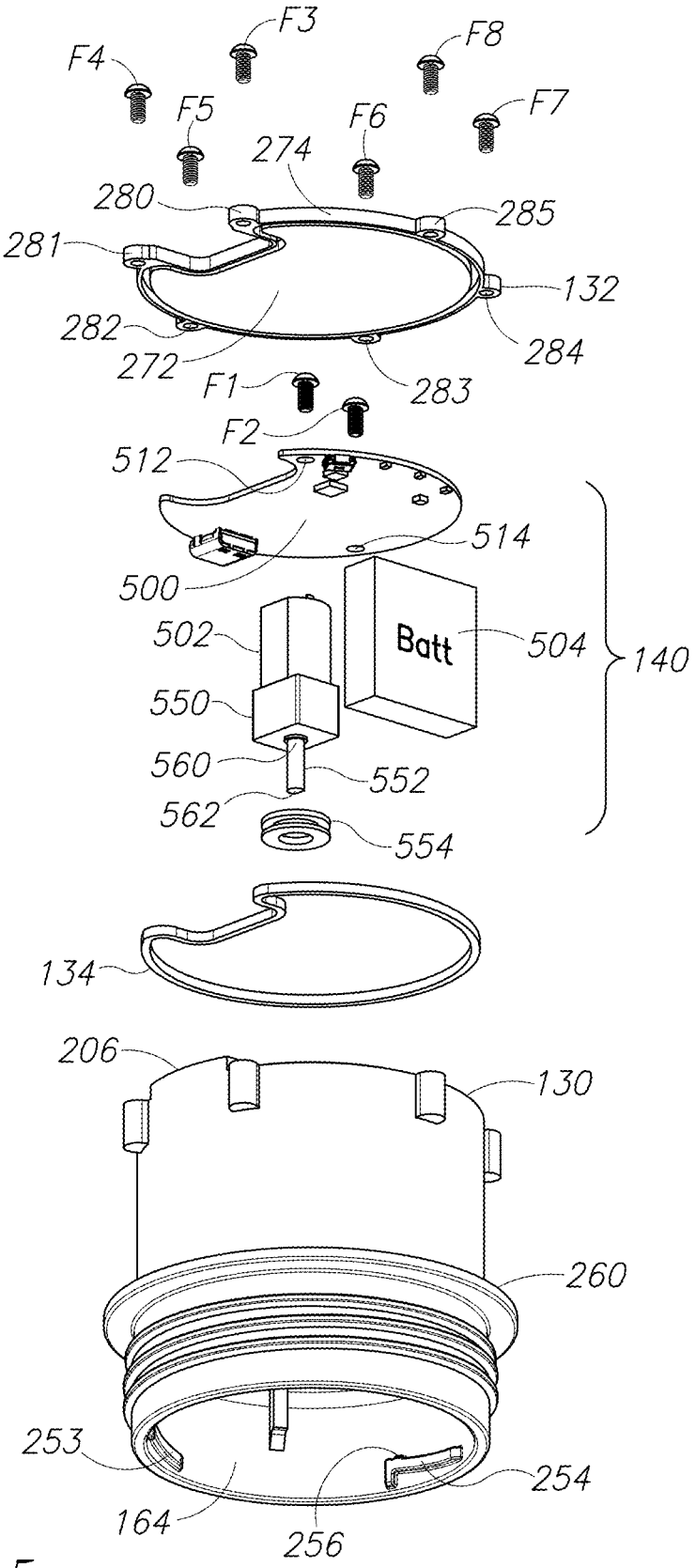
FIG. 15 is an exploded bottom perspective view of fasteners, a lid cover, a drive assembly, a cover seal, and the lid body of the lid assembly of FIG. 5.

Referring to FIG. 5, the lid cover 132 is general planar having an upper surface 270 opposite a lower surface 272 (see FIG. 15). The lid cover 132 is configured to cover the upper edge portion 154 of the outer sidewall 150 and enclose the upper interior portion 162. Thus, the lid cover 132 may have a generally circular outer shape along its outer periphery 274. A notch 276 is formed in the lid cover 132 that allows the distal portion 206 of the inner sidewall 204 to pass through the lid cover 132. Thus, the drinking port 122 is accessible from outside the container 100 (see FIGS. 1-4). In the embodiment illustrated, referring to FIGS. 3 and 4, the upwardly facing surface 210 of the distal portion 206 is coplanar with the upper surface 270 of the lid cover 132.

Referring to FIG. 5, the fasteners F3-F8 removably fasten the lid cover 132 to the lid body 130. Ring-shaped projections 280-285 extend outwardly from the outer periphery 274. The projections 280-285 are configured to allow the fasteners F3-F8 to pass therethrough and into the apertures 240-244 (see FIG. 8), respectively, of the mounting structures 230-235 (see FIG. 8), respectively, extending along the upper edge portion 154 of the outer sidewall 150 of the lid body 130.

The lid cover 132 may be transparent and/or translucent to allow light to shine therethrough.

Cover Seal

Referring to FIG. 5, the optional cover seal 134 may be disposed between the lid cover 132 and the lid body 130. In the embodiment illustrated, the cover seal 134 extends along the upper edge portion 154 of the outer sidewall 150 and across the recessed portion 208 (see FIG. 8) of the inner sidewall 204. The cover seal 134 is configured to help form a liquid tight seal between the lid cover 132 and the lid body 130. By way of a non-limiting example, the cover seal 134 may be constructed from a flexible, compressible, and/or malleable material (e.g., rubber).

Lid Base

Figure 7:
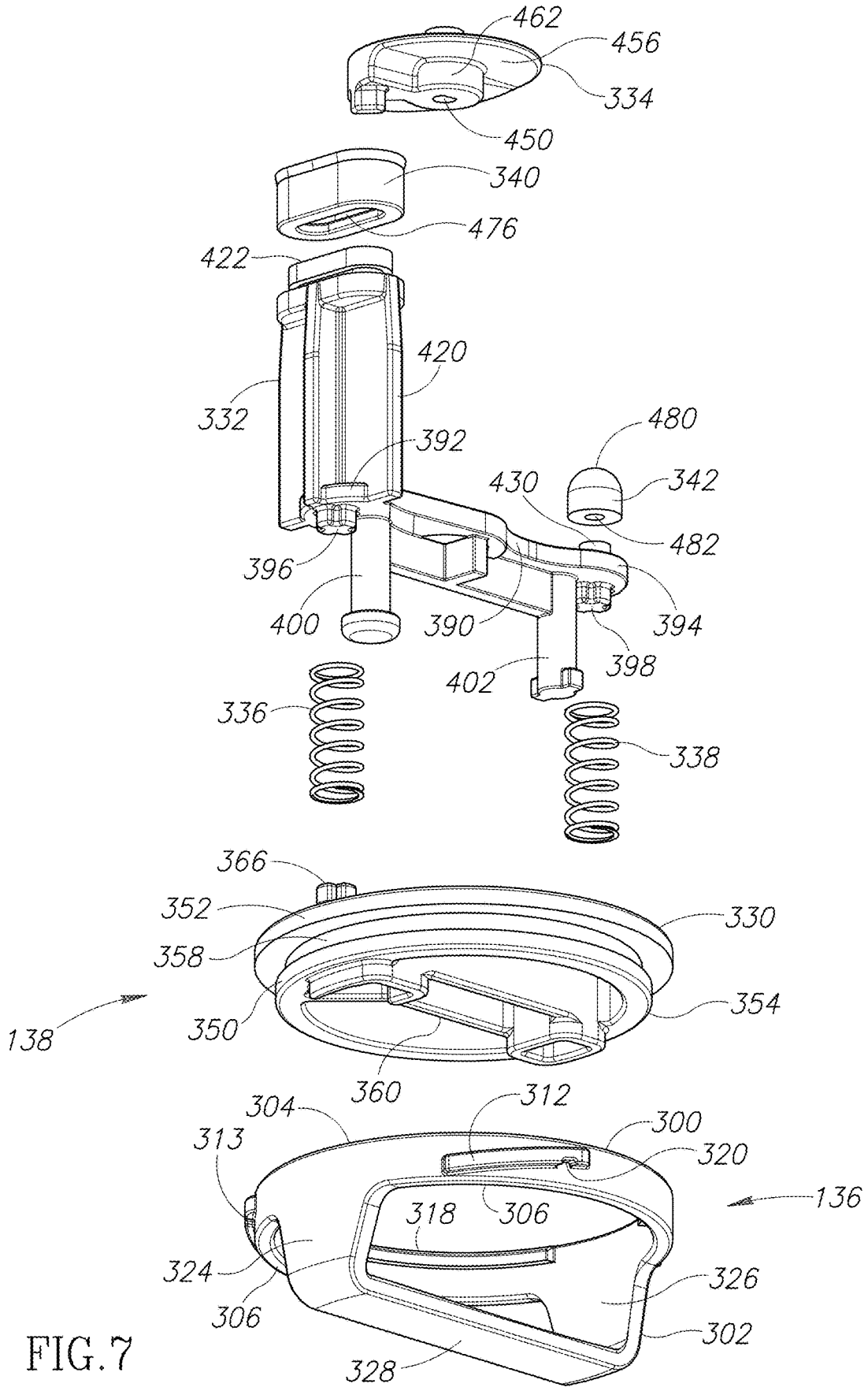
FIG. 7 is an exploded bottom perspective view of the lid base and the plunger assembly of FIG. 6.

Referring to FIG. 7, the removable lid base 136 has a ring-shaped member 300 attached to a handle member 302. The ring-shaped member 300 has an upper edge 304 opposite a lower edge 306. The handle member 302 extends downwardly from the lower edge 306.

Figure 10:
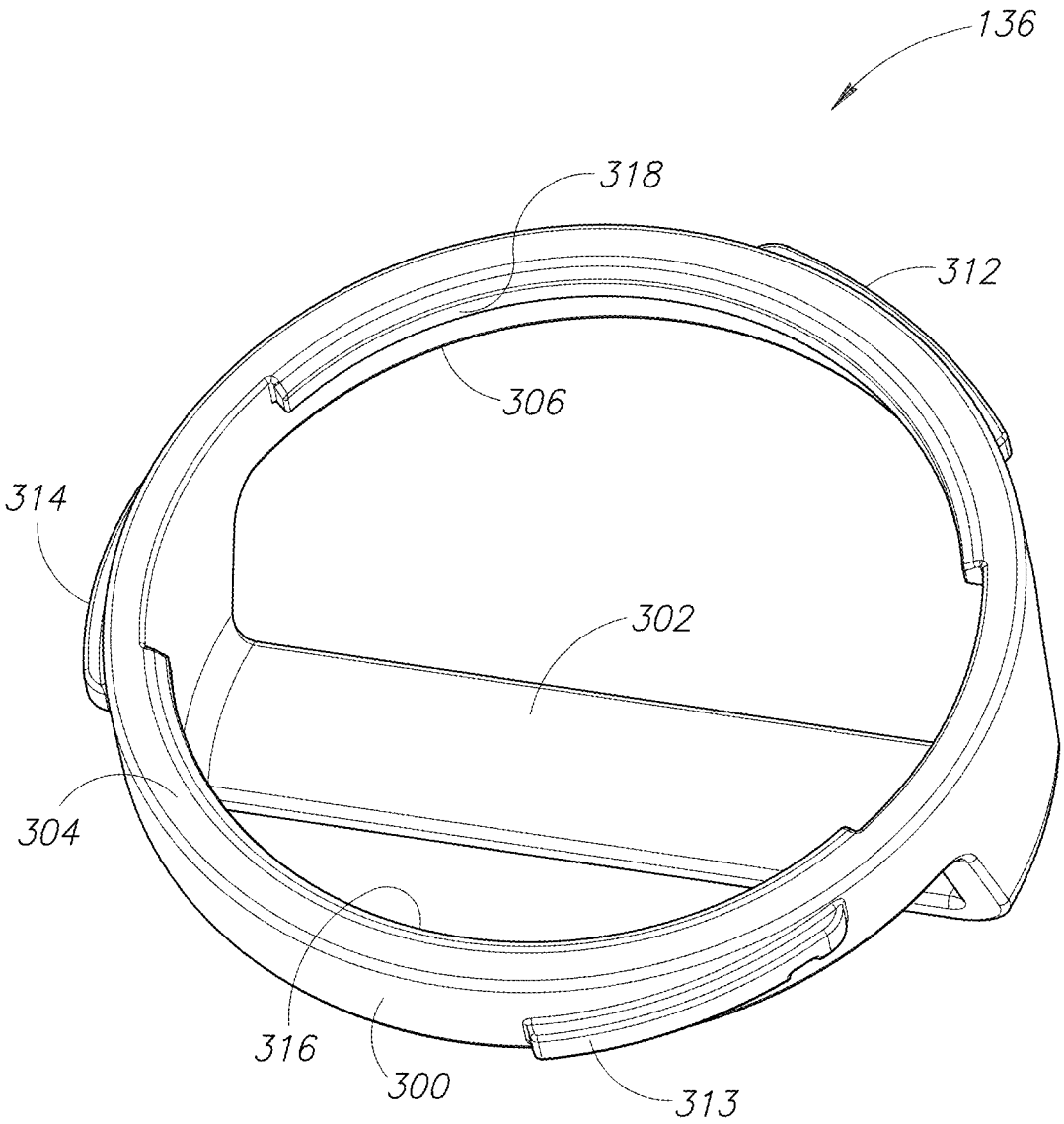
FIG. 10 is a top perspective view of the lid base of the lid assembly of FIG. 5.

Referring to FIG. 5, the lid base 136 is removably mountable inside the lid body 130. Referring to FIG. 10, the ring-shaped member 300 has one or more outwardly extending connector projections 312-314 and a pair of lips 316 and 318 that extend inwardly from the ring-shaped member 300. The outwardly extending connector projections 312-314 are positioned to be inserted in between the inwardly extending connector projections 252-254 (see FIG. 9) of the lid body 130 (see FIGS. 5, 8, 9, and 15). Then, referring to FIG. 5, the lid base 136 is rotated (using the handle member 302) in a direction identified by a curved arrow 319 to position the outwardly extending connector projections 312-314 (see FIG. 10) on top of the inwardly extending connector projections 252-254 (see FIG. 9). Referring to FIG. 7, each of the outwardly extending connector projections 312-314 (see FIG. 10) includes a downwardly opening notch 320 configured to receive the upwardly extending tab 256 (see FIG. 15) of a corresponding one of the inwardly extending connector projections 252-254 (see FIG. 9). Referring to FIG. 5, the lid base 136 may be removed from inside the lid body 130 by optionally pushing upwardly on the lid base 136 (using the handle member 302) to disengage the downwardly opening notches 320 from the upwardly extending tabs 256 (see FIG. 15) and rotating the lid base 136 (using the handle member 302) in a direction opposite the direction identified by the curved arrow 319 until the outwardly extending connector projections 312-314 (see FIG. 10) are no longer on top of the inwardly extending connector projections 252-254 (see FIG. 9). Then, the lid base 136 may be removed from the lid body 130 by sliding the outwardly extending connector projections 312-314 (see FIG. 10) between the inwardly extending connector projections 252-254 (see FIG. 9).

The handle member 302 is generally u-shaped having a first leg portion 324 connected to a second leg portion 326 by an intermediate grip portion 328. The first and second leg portions 324 and 326 are connected to opposite portions of the ring-shaped member 300 and extend downwardly therefrom. Thus, the grip portion 328 is positioned below and extends across the ring-shaped member 300.

Referring to FIG. 5, the plunger assembly 138 is mountable to the lid base 136, which, as described above, is removably mountable inside the lid body 130.

Plunger Assembly

Figure 6:
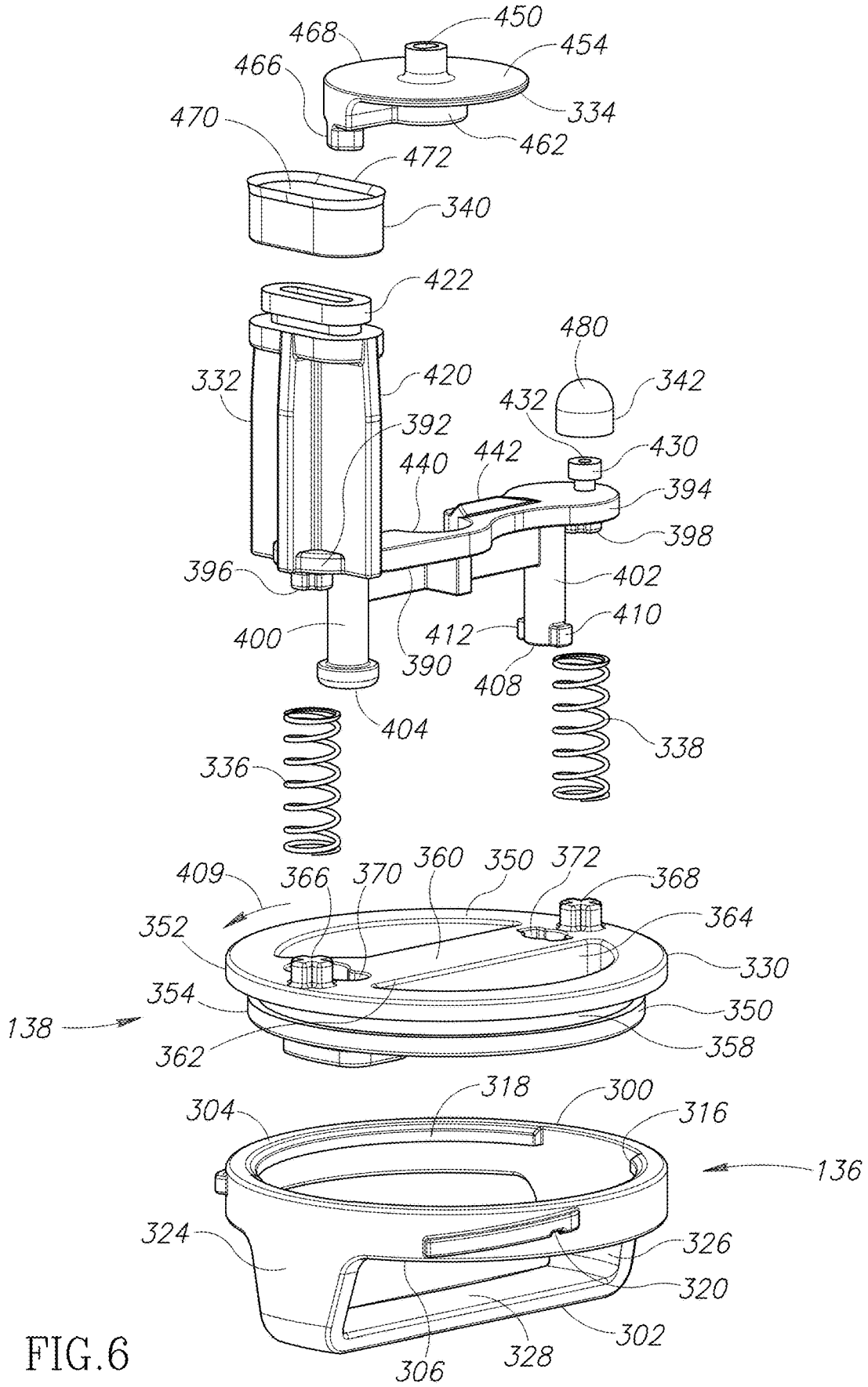
FIG. 6 is an exploded top perspective view of a lid base and a plunger assembly of the lid assembly of FIG. 5.
Figure 13:
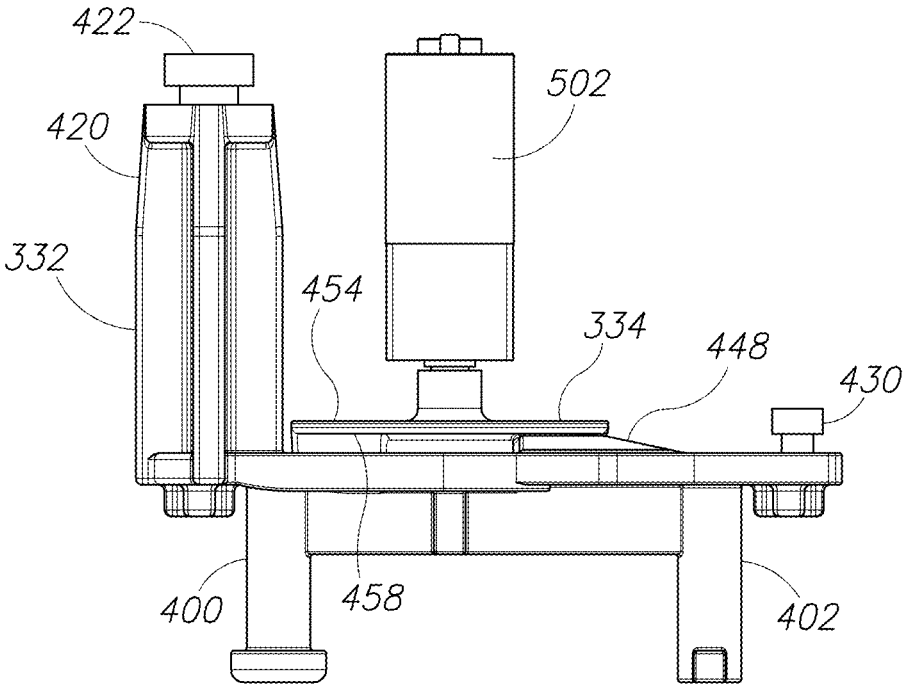
FIG. 13 is a side elevational view of an assembly that includes the plunger member, a cam member, and a motor of the beverage container of FIG. 1.

Referring to FIG. 5, the plunger assembly 138 may be characterized as being a mechanism that seals and unseals the drinking port 122. Referring to FIGS. 6 and 7, the plunger assembly 138 includes a cartridge member 330, a movable plunger member 332, a rotatable cam member 334, a pair of biasing members 336 and 338, a seal or plug member 340, and a vent seal 342. The cam member 334 is configured to transition between an open position (see FIG. 4) and a closed position (see FIGS. 3, 13, and 14). When the cam member 334 is rotated to the open position (see FIG. 4), the cam member 334 moves the plunger member 332 to the open position (see FIG. 4). Similarly, when the cam member 334 is rotated to the closed position (see FIGS. 3, 13, and 14), the biasing members 336 and 338 move the plunger member 332 to a closed position (see FIG. 3).

Referring to FIG. 6, the cartridge member 330 has a generally ring-shaped portion 350 with an upper portion 352 that overhangs a lower recessed portion 354. The lower recessed portion 354 is configured to be received inside the ring-shaped member 300 of the lid base 136. The lower recessed portion 354 has an annular outer groove 358 formed therein that is configured to receive and house the lips 316 and 318 of the lid base 136. Thus, the lid base 136 and the cartridge member 330 may be assembled together.

Figure 11:
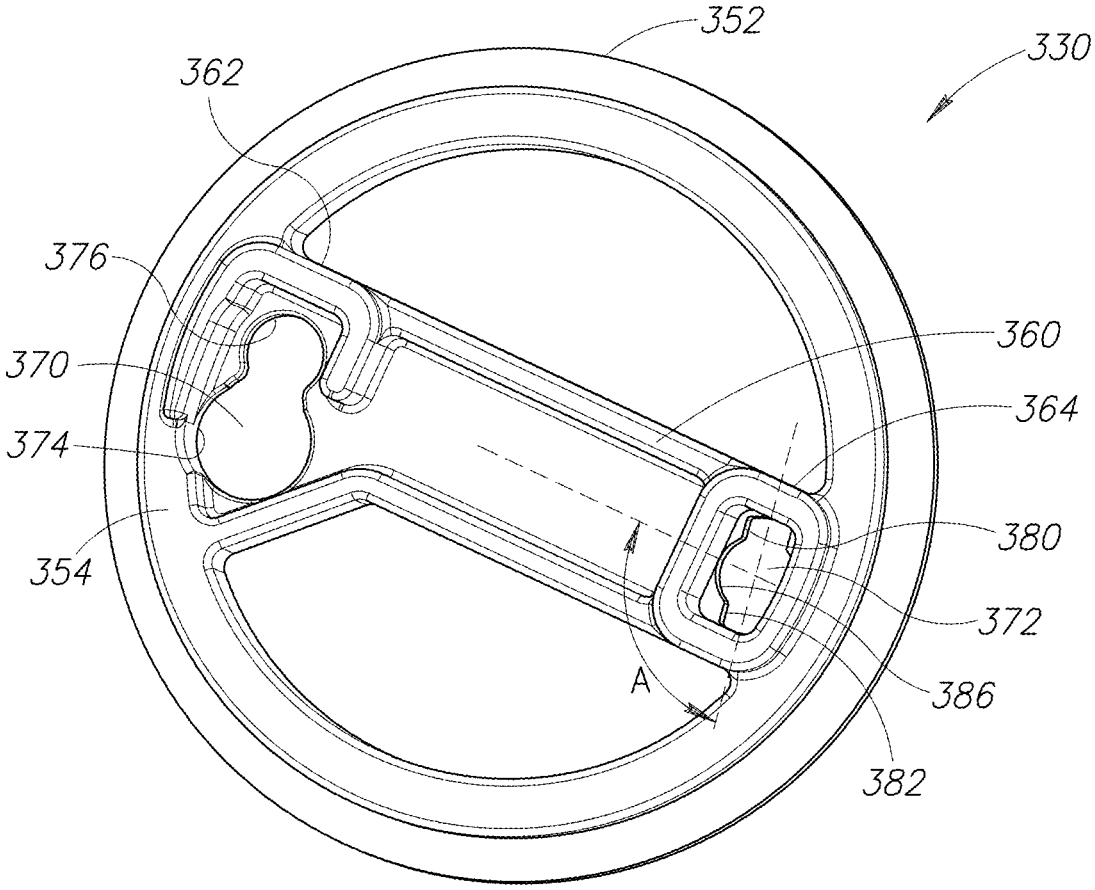
FIG. 11 is a bottom perspective view of a cartridge member of the plunger assembly of FIG. 6.

Referring to FIGS. 6 and 7, a bridge portion 360 extends across the ring-shaped portion 350. Referring to FIG. 6, at opposite first and second ends 362 and 364 of the bridge portion 360, projections 366 and 368, respectively, extend upwardly from the upper portion 352. At the first end 362, the bridge portion 360 includes a first through-hole 370 positioned near the first projection 366. At the second end 364, the bridge portion 360 includes a second through-hole 372 positioned near the second projection 368. Referring to FIG. 11, in the embodiment illustrated, the first through-hole 370 has a keyway portion 374 adjacent a plunger receiving portion 376. The second through-hole 372 has a pair of side keyway portions 380 and 382 flanking a central plunger receiving portion 386. The side keyway portions 380 and 382 extend away from the plunger receiving portion 386 at an angle "A" with respect the bridge portion 360.

Referring to FIGS. 6 and 7, the plunger member 332 is removably mounted to the cartridge member 330. The plunger member 332 has a body portion 390 with a first end portion 392 opposite a second end portion 394. At the first end portion 392, a first projection 396 extends downwardly from the body portion 390. At the second end portion 394, a second projection 398 extends downwardly from the body portion 390. Referring to FIG. 6, the projections 396 and 398 may be substantially similar to the projections 366 and 368 of the cartridge member 330.

A first anchor projection 400 extends downwardly from the first end portion 392 of the body portion 390. The first anchor projection 400 is spaced inwardly from the first projection 396. A second anchor projection 402 extends downwardly from the second end portion 394 of the body portion 390. The second anchor projection 402 is spaced inwardly from the second projection 398.

The first anchor projection 400 includes a distal key member 404 configured to be received by the keyway portion 374 (see FIG. 11) of the first through-hole 370. The first anchor projection 400 is slidable from the keyway portion 374 (see FIG. 11) to the plunger receiving portion 376 (see FIG. 11) of the first through-hole 370 after the distal key member 404 has been inserted through the keyway portion 374 (see FIG. 11). The distal key member 404 is configured not to pass through the plunger receiving portion 376 (see FIG. 11). Thus, the distal key member 404 prevents the first anchor projection 400 from being removed from the plunger receiving portion 376 (see FIG. 11) of the first through-hole 370.

A distal end 408 of the second anchor projection 402 is flanked by a pair of key members 410 and 412 configured to pass through the side keyway portions 380 and 382 (see FIG. 11), respectively, flanking the plunger receiving portion 386 (see FIG. 11) of the second through-hole 372. The angle "A" (see FIG. 11) is configured to allow the distal end 408 of the second anchor projection 402 to pass through the plunger receiving portion 386 (see FIG. 11) with the key members 410 and 412 passing through the side keyway portions 380 and 382 (see FIG. 11), respectively. At the same time, the distal key member 404 of the first anchor projection 400 is received by the keyway portion 374 (see FIG. 11) of the first through-hole 370. Then, the plunger member 332 is rotated in a direction identified by a curved arrow 409 to slide the first anchor projection 400 from the keyway portion 374 (see FIG. 11) to the plunger receiving portion 376 (see FIG. 11) of the first through-hole 370. This rotation places the key members 410 and 412 out of alignment with the side keyway portions 380 and 382 (see FIG. 11), respectively. Thus, the key members 410 and 412 prevent the second anchor projection 402 from being removed from the plunger receiving portion 386 (see FIG. 11) of the second through-hole 372. At the same time, the distal key member 404 prevents the first anchor projection 400 from being removed from the plunger receiving portion 376 (see FIG. 11) of the first through-hole 370. The plunger member 332 may be removed from the cartridge member 330 by rotating the plunger member 332 a direction opposite the direction identified by the curved arrow 409 to slide the first anchor projection 400 from the plunger receiving portion 376 (see FIG. 11) to the keyway portion 374 (see FIG. 11) of the first through-hole 370. At the same time, the key members 410 and 412 are aligned with the side keyway portions 380 and 382 (see FIG. 11), respectively. Then, the plunger member 332 may be lifted from the cartridge member 330 to disengage the first and second anchor projections 400 and 402 from the first and second through-holes 370 and 372, respectively.

Referring to FIGS. 6 and 7, a first seal mounting projection 420 extends upwardly from the first end portion 392 of the body portion 390. The first seal mounting projection 420 has a free distal end 422 configured to receive the plug member 340.

A second seal mounting projection 430 extends upwardly from the second end portion 394 of the body portion 390. Referring to FIG. 6, the second seal mounting projection 430 has a free distal end 432 configured to receive the vent seal 342.

Figure 12:
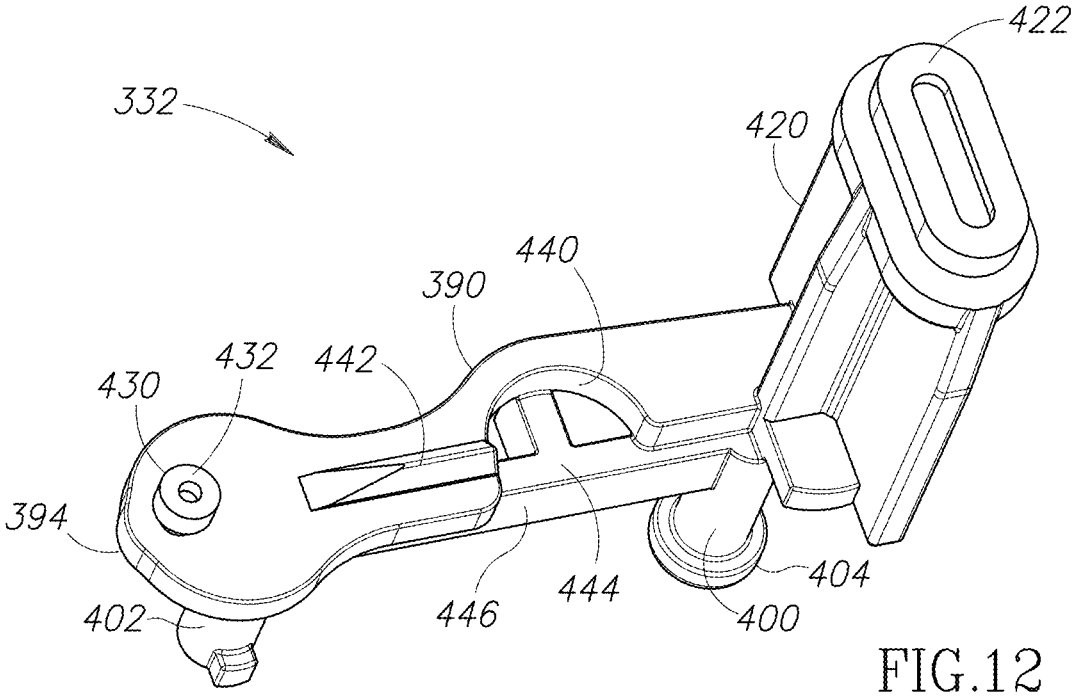
FIG. 12 is a top perspective view of a plunger member of the plunger assembly of FIG. 6.

Referring to FIG. 6, the body portion 390 has an opening or a recess 440 configured to receive the cam member 334. Referring to FIG. 12, a raised portion 442 extends upwardly from the body portion 390 adjacent the recess 440. A horizontal support member 444 extends between the first and second anchor projections 400 and 402 and below the recess 440. The support member 444 has a side surface 446 that provides a stop wall for the cam member 334 (see FIGS. 3-7, 13, and 14).

Figure 14:
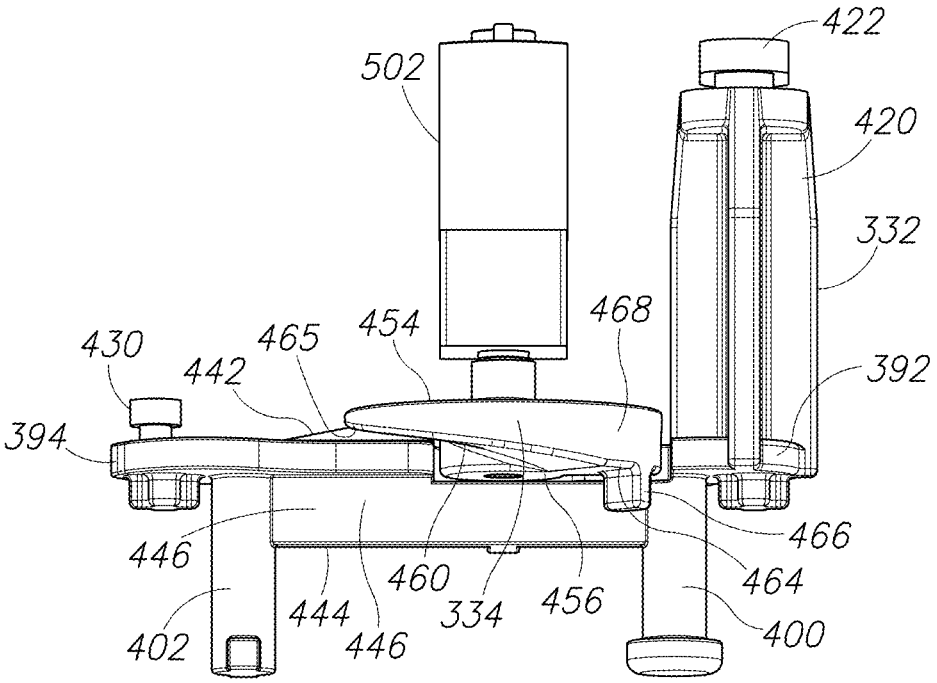
FIG. 14 is a perspective view of the assembly of FIG. 13 showing a side opposite the side shown in FIG. 13.

Referring to FIGS. 6 and 7, the rotatable cam member 334 has a central through-channel 450 extending therethrough along the vertical axis "V" (see FIG. 1). In the embodiment illustrated, the cam member 334 is generally disk shaped. The cam member 334 has an upper planar surface 454 opposite a lower surface 456. The lower surface 456 has a planar portion 458 (see FIG. 13) opposite an inclined portion 460 (see FIG. 14). A central projection 462 extends downwardly from the lower surface 456. Referring to FIG. 6, the projection 462 is configured to be received inside the recess 440 of the plunger member 332 with the inclined portion 460 (see FIG. 14) resting upon the raised portion 442. A stop member 466 extends downwardly from the lower surface 456 along a periphery 468 of the cam member 334. Referring to FIG. 14, the stop member 466 is positioned at a lower portion 464 of the inclined portion 460. The inclined portion 460 has a higher portion 465 spaced apart from the lower portion 464.

Figure 3:
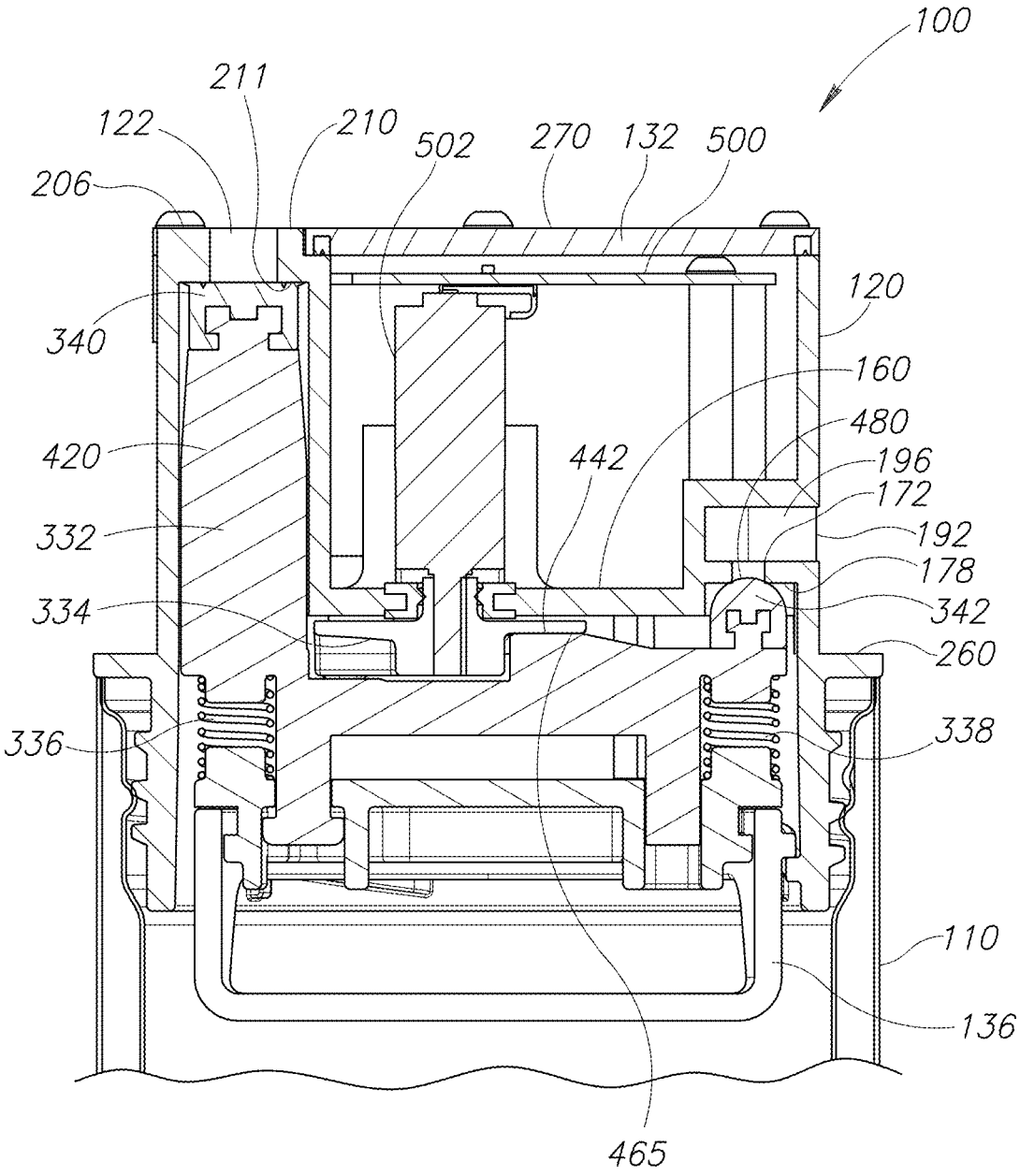
FIG. 3 is a cross-sectional view of the beverage container with its drinking port closed taken through a plane defined by axes "R" and "V" of FIG. 1.
Figure 4:
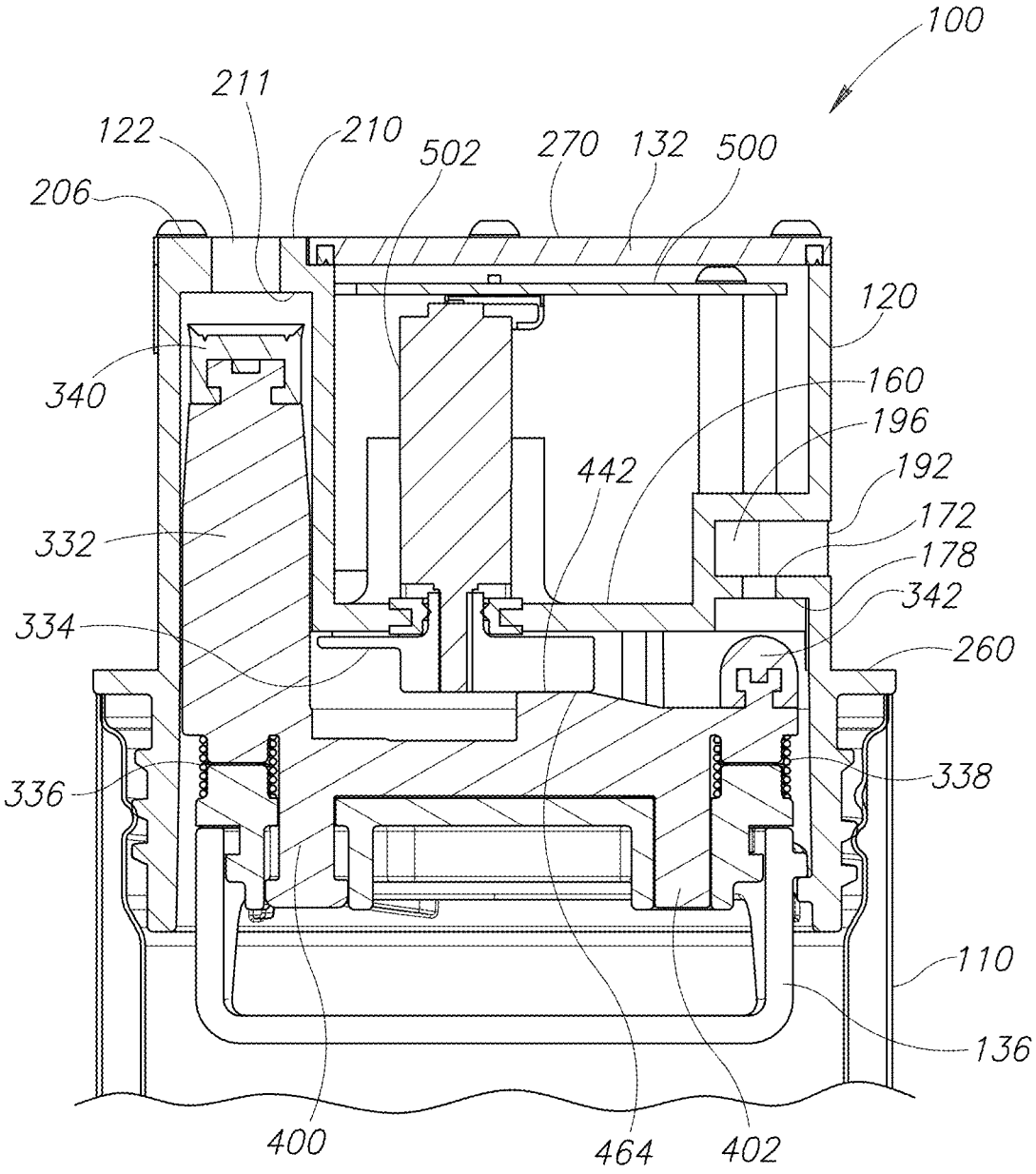
FIG. 4 is a cross-sectional view of the beverage container with its drinking port open taken through the plane defined by axes "R" and "V" of FIG. 1.

When the cam member 334 is in the closed position (see FIGS. 3, 13, 14), the stop member 466 bears against a portion of the side surface 446 of the support member 444 near the first end portion 392 of the plunger member 332. In this position, the higher portion 465 of the inclined portion 460 is positioned upon the raised portion 442. Referring to FIG. 3, the higher portion 465 (see FIG. 14) allows the biasing members 336 and 338 to push the plunger member 332 upwardly. The plunger member 332 carries the plug member 340 and pushes the plug member 340 against the downwardly facing surface 211, which closes the drinking port 122. Referring to FIG. 14, on the other hand, when the cam member 334 is in the open position (see FIG. 4), the stop member 466 bears against a different portion of the side surface 446 of the support member 444 near the second end portion 394 of the plunger member 332. Referring to FIG. 4, in this position, the lower portion 464 of the inclined portion 460 is positioned upon the raised portion 442. The lower portion 464 pushes against the raised portion 442 and pushes the plunger member 332 downwardly compressing the biasing members 336 and 338 and spacing the plug member 340 from the drinking port 122, which opens the drinking port 122.

Referring to FIG. 6, the biasing members 336 and 338 bias the plunger member 332 upwardly away from the cartridge member 330. In the embodiment illustrated, the biasing members 336 and 338 have each been implemented as a coil spring. The biasing members 336 and 338 are configured to be seated on the projections 366 and 368, respectively. In the embodiment illustrated, the biasing members 336 and 338 receive the projections 366 and 368, respectively, which extend upwardly into the biasing members 336 and 338, respectively. Likewise, the biasing members 336 and 338 receive the projections 396 and 398, respectively, which extend downwardly into the biasing members 336 and 338, respectively. Thus, the biasing members 336 and 338 are sandwiched between the plunger member 332 and the cartridge member 330. As the plunger member 332 moves with respect to the cartridge member 330 from the closed position to the open position, the biasing members 336 and 338 are compressed between the plunger member 332 and the cartridge member 330.

Referring to FIGS. 3 and 4, the plug member 340 is configured to abut the downwardly facing surface 211 and form a seal therewith when the plunger member 332 is in the closed position (see FIG. 3). Referring to FIG. 6, the plug member 340 has an upper surface 470 surrounded by an upwardly extending lip 472. Referring to FIG. 7, opposite the upper surface 470 (see FIG. 6), the plug member 340 has an aperture 476 configured to receive the free distal end 422 of the first seal mounting projection 420 of the plunger member 332. The plug member 340 is carried by the plunger member 332 as the plunger member 332 transitions between the open and closed positions. Referring to FIG. 6, when the plunger member 332 transitions to the closed position from the open position, the upper surface 470 and/or the upwardly extending lip 472 abuts the downwardly facing surface 211 (see FIGS. 3, 4, and 9) and forms a seal therewith closing the drinking port 122 (see FIGS. 1-5 and 8). On the other hand, when the plunger member 332 transitions to the open position from the closed position, the plug member 340 moves away from the downwardly facing surface 211 allowing the liquid 124 (see FIG. 1) to flow passed the plug member 340 and out through the drinking port 122 (see FIGS. 1-5 and 8).

The vent seal 342 has an upper surface 480 opposite a downwardly opening aperture 482 (see FIG. 7) configured to receive the free distal end 432 of the second seal mounting projection 430 of the plunger member 332. The vent seal 342 is carried by the plunger member 332 as the plunger member 332 transitions between the open and closed positions. Referring to FIG. 3, when the plunger member 332 transitions to the closed position from the open position, the upper surface 480 is received inside the recess 178 formed in the underside of the platform 160 and blocks the vent through-hole 172 to form a seal that prevents gases (e.g., steam) from flowing through the vent through-channel 196 that connects the vent aperture 192 to the vent through-hole 172. Referring to FIG. 4, on the other hand, when the plunger member 332 transitions to the open position from the closed position, the vent seal 342 moves away from the vent through-hole 172 allowing the gases (e.g., steam) to flow passed the vent seal 342, through the vent through-channel 196, and out the vent aperture 192 into the environment outside the container 100. Thus, when the drinking port 122 is open, the vent through-hole 172 is also open. On the other hand, when the drinking port 122 is closed, the vent through-hole 172 is also closed.

By way of a non-limiting example, the plug member 340 and the vent seal 342 may each be constructed from a flexible, compressible, and/or malleable material (e.g., rubber, silicone, and the like).

Drive Assembly

Referring to FIG. 5, the drive assembly 140 rotates the cam member 334 between the open and closed positions, which moves the plunger member 332 between the open and closed positions, respectively. The drive assembly 140 includes a substrate 500 (e.g., implemented as a printed circuit board), a drive mechanism 502 (e.g., an electric motor, a solenoid, and the like), and a power source 504 (e.g., a battery). The power source 504 provides power to both the drive mechanism 502 and drive circuitry 510 (see FIG. 16) mounted on the substrate 500. The substrate 500 may include through-holes 512 and 514 configured to receive the fasteners F1 and F2, which couple the substrate 500 to the mounting structures 220 and 221 (see FIG. 8), respectively.

Figure 16:
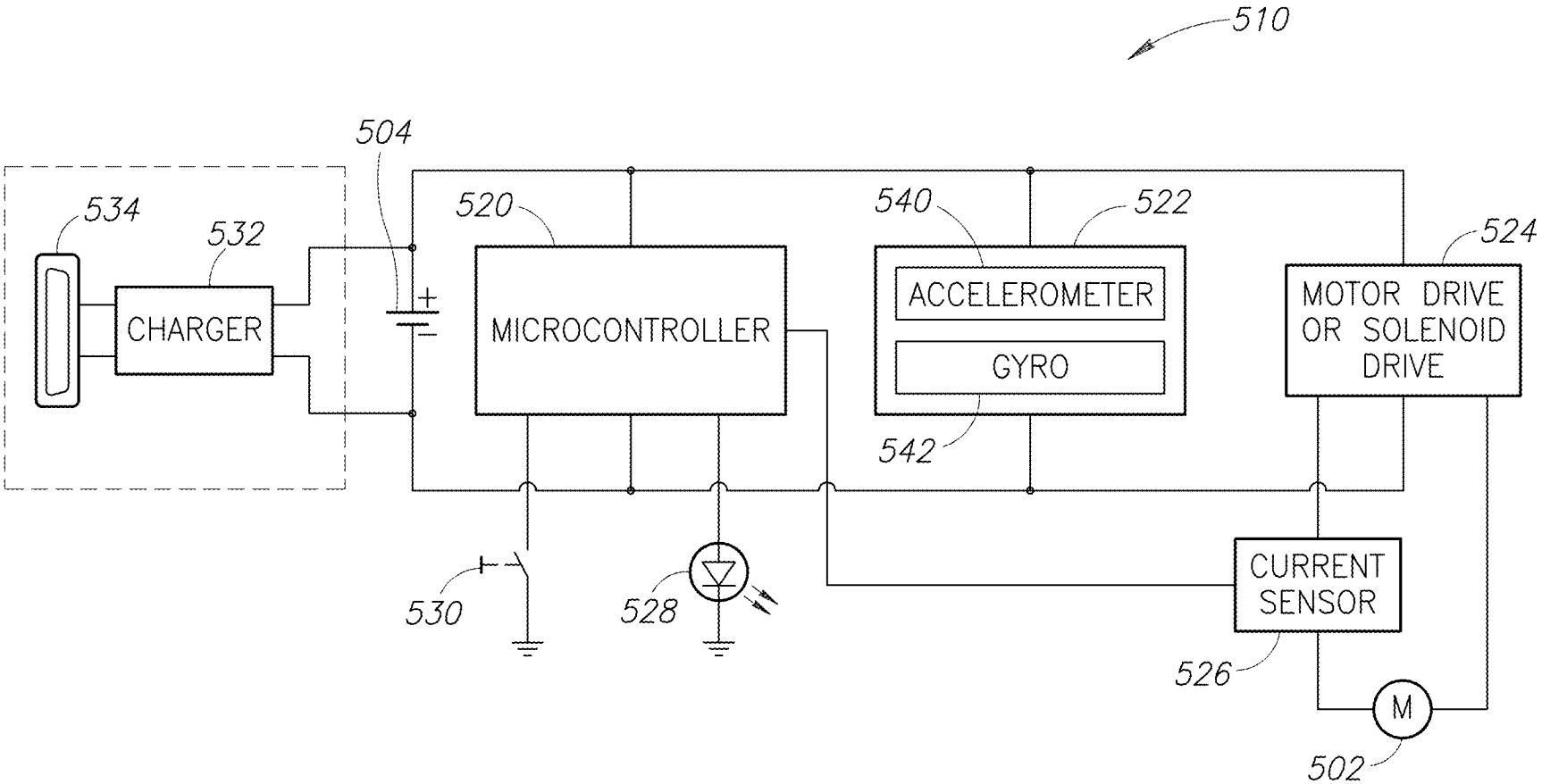
FIG. 16 is a schematic of drive circuitry connected to the motor and mounted on a substrate of the drive assembly of FIG. 15.

FIG. 16 depicts exemplary elements of the drive circuitry 510. Referring to FIG. 16, the drive circuitry 510 is configured to operate and control the drive mechanism 502. In the example illustrated, the drive circuitry 510 includes a microcontroller 520, an inertial measurement unit ("IMU") 522, a drive element 524 (e.g., a motor drive, a solenoid drive, and the like), and a current sensor 526. Optionally, the drive circuitry 510 may include one or more light emitting diode ("LED") 528, a lockout switch 530, and/or a charger 532 with a port 534 (e.g., a USB port). The power source 504 and the drive mechanism 502 are both connected to the drive circuitry 510. In the embodiment illustrated, the microcontroller 520, the IMU 522, and the drive element 524 are each connected to the power source 504 in parallel. The current sensor 526 is connected both the microcontroller 520 and the drive element 524. The drive mechanism 502 is connected to the current sensor 526 and the drive element 524. The microcontroller 520 is also connected to the lockout switch 530 and the LED(s) 528, which are each connected to ground. The optional charger 532 is connected across the power source 504 and in parallel with the microcontroller 520, the IMU 522, and the drive element 524. The port 534 is connected to the charger 532 and configured to supply power thereto.

The IMU 522 may include a microelectromechanical three-axis accelerometer 540 and a three-axis gyroscope 542, as well as on-board associated signal processing/conditioning (not shown) and a digital output (not shown). For ease of illustration, the accelerometer 540 and the gyroscope 542 will be described as measuring information with respect to a common set of three orthogonal axes that will be referred to as a pitch axis "P," a roll axis "R," and the vertical axis "V" (see FIG. 1). Referring to FIG. 1, the pitch axis "P" is the predominant axis used for drinking.

The accelerometer 540 (see FIG. 16) is configured to provide acceleration along each of the pitch, roll, and vertical axes "P," "R," and "V," which may be summed to obtain a total acceleration value. By way of a non-limiting example, the total acceleration value may be measured in multiples of the acceleration of gravity ("G"), which is about 9.8 meters per second per second ($m/s^2$). When the container 100 is sitting static on a desk, the total acceleration value is approximately 1.0 G.

The gyroscope 542 (see FIG. 16) is configured to provide an angle of rotation and a rate of rotation about each of the pitch, roll, and vertical axes "P," "R," and "V." However, only the angle and rate of rotation about the pitch and roll axes "P" and "R" are used. By way of a non-limiting example, the angle of rotation may be measured in degrees with positive rotation being in directions identified by curved arrows 544 and 546 about the pitch and roll axes "P" and "R," respectively. The rate of rotation may be measure in degrees per second. The gyroscope 542 (see FIG. 16) may be configured to measure the rate of rotation about each of the pitch and roll axes "P" and "R" at a bandwidth of approximately 50 Hz. However, a different (e.g., lower or higher) bandwidth may be used.

As mentioned above, referring to FIG. 5, the lid cover 132 may be transparent and/or translucent to allow light to shine therethrough. In such embodiments, the LED(s) 528 (see FIG. 16) may be positioned such that light emitted by the LED(s) 528 may shine through the lid cover 132.

Referring to FIG. 15, in the embodiment illustrated, the drive mechanism 502 includes a motor 550, a motor shaft 552, and a bushing or motor seal 554. The motor 550 is rotatable in a closing direction (illustrated by a curved arrow 556 in FIG. 5) and an opening direction that is opposite the closing direction. The direction in which the motor 550 rotates is determined by the drive element 524 (see FIG. 16). In the embodiment illustrated, the motor 550 is mounted within the area 184 (see FIG. 8) between the sidewalls 180 and 182 (see FIG. 8).

The motor shaft 552 has a proximal end 560 opposite a distal end 562. The proximal end 560 is coupled to the motor 550, which rotates the motor shaft 552 thereby. The motor shaft 552 extends downwardly from the motor 550 and through the motor seal 554 and positions the distal end 562 in the central through-channel 450 (see FIGS. 6 and 7) of the cam member 334 (see FIGS. 3-7, 13, and 14). When the motor 550 rotates the motor shaft 552, the cam member 334 rotates therewith.

The motor seal 554 is configured to be received inside the central through-hole 170 (see FIGS. 8 and 9) that extends through the platform 160 (see FIGS. 3, 4, 8, and 9). The motor seal 554 creates a circumferential seal around a portion of the motor shaft 552 between the proximal and distal ends 560 and 562 and seals the upper interior portion 162 (see FIGS. 5 and 8) from the lower interior portion 164. Thus, the motor seal 554 prevents the liquid 124 (see FIG. 1) from entering the upper interior portion 162 (see FIGS. 5 and 8) along the motor shaft 552 and through the central through-hole 170 (see FIGS. 8 and 9).

Method

Figure 17:
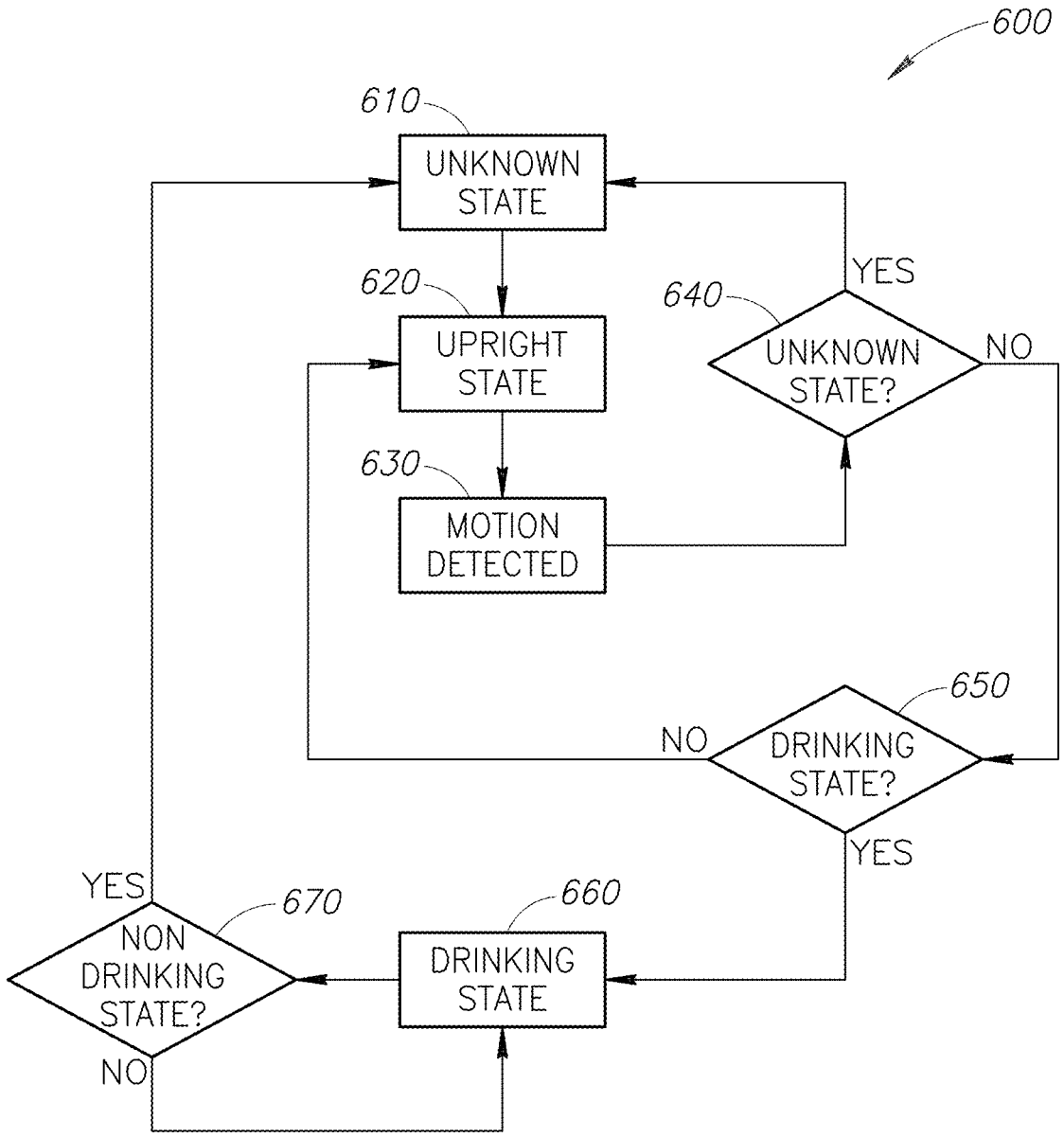
FIG. 17 is a flow diagram of a method performed by the drive circuitry of FIG. 16.

FIG. 17 is a flow diagram of a method 600 performed by the microcontroller 520 (see FIG. 16). Referring to FIG. 16, the microcontroller 520 uses the IMU 522 to sense motion(s) of the container 100 (see FIGS. 1-4) and determine a state of the container 100. Based on the state of the container 100, the microcontroller 520 also directs the drive element 524 to move the plunger assembly 138 (see FIGS. 5-7) to open or close the drinking port 122 (see FIGS. 1-5 and 8). The container 100 (see FIGS. 1-4) may be in one of the following states:

1. an unknown state (block 610) in which the drinking port 122 (see FIGS. 1-5 and 8) is closed;
2. an upright state (block 620) in which the drinking port 122 (see FIGS. 1-5 and 8) is closed; and
3. a drinking state (block 660) in which the drinking port 122 (see FIGS. 1-5 and 8) is open.

Referring to FIG. 1, rotation about the pitch and roll axes "P" and "R" is zero when the container 100 is in an upright and stationary position (illustrated in FIG. 1). Additionally, when the container 100 is in the upright and stationary position, the total acceleration value will indicate static acceleration (e.g., 1 G). The method 600 (see FIG. 17) may be characterized as using information obtained from the gyroscope 542 (see FIG. 16) regarding motion about the pitch axis "P" (such as angle of rotation and rotation rate) to determine whether the user is drinking, has finished drinking, etc. The method 600 (see FIG. 17) may also be characterized as using information obtained from the gyroscope 542 (see FIG. 16) regarding motion about the roll axis "R" to determine when an excessive roll angle has occurred (e.g., greater than about 45 degrees) which indicates misuse of the container 100 or accidentally spillage of the liquid 124.

Referring to FIG. 17, during the performance of the method 600, the microcontroller 520 (see FIG. 16) occasionally (e.g., periodically) queries the IMU 522 for rotation and acceleration information. From this information, the microcontroller 520 (see FIG. 16) obtains the angles of rotation about the angles of rotation about the pitch and roll axes "P" and "R" (see FIG. 1), a rate of rotation about the pitch axis "P," and the total acceleration value.

In first block 610, the microcontroller 520 (see FIG. 16) starts out with the container 100 (see FIGS. 1-4) in the unknown state. When the container 100 is in the unknown state, the drinking port 122 (see FIGS. 1-5 and 8) is closed. The container 100 remains in the unknown state until the microcontroller 520 detects that the container 100 is in the upright state.

In block 620, the microcontroller 520 detects that the container 100 is in the upright state. By way of a non-limiting example, the microcontroller 520 may detect that the container 100 is in the upright state when the angles of rotation about the pitch and roll axes "P" and "R" (see FIG. 1) are less than pitch and roll lower angle thresholds, respectively, and the total acceleration value is between upper and lower acceleration thresholds. By way of non-limiting examples, the pitch and roll lower angle thresholds may each be about 20 degrees, the lower acceleration threshold may be about 0.5 G, and the upper acceleration threshold may be about 1.5 G.

Next, in block 630, the microcontroller 520 detects that the container 100 has begun to move. By way of a non-limiting example, the microcontroller 520 may determine that the container 100 is moving when the angle of rotation about the pitch axis "P" (see FIG. 1) is greater than the pitch lower angle threshold (e.g., about 20 degrees).

In decision block 640, the microcontroller 520 (see FIG. 16) determines whether the motion detected in block 630 has transitioned the container 100 (see FIGS. 1-4) to the unknown state or another state. The decision in decision block 640 is "YES," when the microcontroller 520 determines the container 100 has transitioned to the unknown state. Otherwise, the decision in decision block 640 is "NO." By way of a non-limiting example, the microcontroller 520 may determine the container 100 has transitioned to the unknown state when the angle of rotation about the roll axis "R" (see FIG. 1) is greater than a roll upper angle threshold and/or the total acceleration value is between the upper and lower acceleration thresholds. By way of a non-limiting example, the roll upper angle threshold may be about 45 degrees.

When the decision in decision block 640 is "YES," the microcontroller 520 (see FIG. 16) returns to first block 610 and may trigger an error condition. On the other hand, when the decision in decision block 640 is "NO," the microcontroller 520 advances to decision block 650.

In decision block 650, the microcontroller 520 (see FIG. 16) determines whether the container 100 (see FIGS. 1-4) has transitioned to the drinking state or has remained in the upright state. The decision in decision block 650 is "YES," when the microcontroller 520 determines the container 100 has transitioned to the drinking state. Otherwise, the decision in decision block 650 is "NO." By way of a non-limiting example, the microcontroller 520 may determine the container 100 has transitioned to the drinking state when (1) the angle of rotation about the pitch axis "P" (see FIG. 1) is between the pitch lower angle threshold (e.g., about 20 degrees) and a pitch upper angle threshold for at least a predetermined time period (e.g., sufficient for the container 100 to reach a drinking angle), and (2) the total acceleration value is between the upper and lower acceleration thresholds (e.g., 0.5 G>=the total acceleration value<=1.5 G). By way of a non-limiting example, the pitch upper angle threshold may be about 180 degrees and the predetermined time period may be about 2 seconds.

When the decision in decision block 650 is "NO," the microcontroller 520 (see FIG. 16) returns to block 620. On the other hand, when the decision in decision block 650 is "YES," the microcontroller 520 advances to block 660.

In block 660, the container 100 (see FIGS. 1-4) is in the drinking state and the microcontroller 520 (see FIG. 16) instructs the drive element 524 to open the drinking port 122. Thus, referring to FIG. 5, the microcontroller 520 (see FIG. 16) instructs the drive element 524 (see FIG. 16) to cause the drive mechanism 502 to rotate the cam member 334 in the closing direction identified by the curved arrow 556.

Returning to FIG. 17, in decision block 670, the microcontroller 520 (see FIG. 16) determines whether the container 100 (see FIGS. 1-4) has transitioned to the unknown state or remains in the drinking state. The decision in decision block 670 is "YES," when the microcontroller 520 determines the container 100 has transitioned to the unknown state. Otherwise, the decision in decision block 670 is "NO." By way of a non-limiting example, the microcontroller 520 may determine the container 100 transitioned to the unknown state when rotation about the pitch axis "P" (see FIG. 1) is less than the pitch lower angle threshold (e.g., about 20 degrees), rotation about the roll axis "R" (see FIG. 1) is greater than the roll upper angle threshold (e.g., about 45 degrees), or the total acceleration value is between the upper and lower acceleration thresholds.

When the decision in decision block 670 is "YES," the microcontroller 520 (see FIG. 16) returns to block 610. On the other hand, when the decision in decision block 670 is "NO," the microcontroller 520 returns to block 660.

Thus, during normal drinking, the method 600 flows from the unknown state in first block 610 to the upright state in block 620 to detecting motion in block 630. Then, the method 600 flows from decision block 640 to decision block 650 to the drinking state in block 660. Finally, the method 600 flows to decision block 670 and returns to the unknown state in first block 610. Thus, after drinking, as the container 100 (see FIGS. 1-4) is returned to vertical and the drinking port 122 (see FIGS. 1-5 and 8) is closed.

The microcontroller 520 (see FIG. 16) detects the unknown state (block 610) when one of several "error states" occurs (and the user would not want the drinking port 122 to open). For example, a first error state occurs when the user starts a brisk walk or jog. When the user is walking, the container is experiencing moderate acceleration and is in nearly the position as when the container 100 is sitting on a surface. Thus, when the user is walking, the container 100 will remain in the upright state. On the other hand, when the user starts a brisk walk or jog, an error state is tripped because the acceleration exceeds the upper acceleration threshold. Thus, when the user is walking and breaks into a brisk walk or jog, the drinking port 122 will close or remain closed and the microcontroller 520 will return to block 610 (wherein the container 100 is in the unknown state).

By way of another non-limiting example, a second error state occurs when the container 100 is dropped or tips over suddenly (e.g., the container 100 is knocked over on a desk). When the container 100 is dropped or tips over suddenly, the IMU 522 senses a sudden drop in acceleration as the container 100 falls. Thus, the acceleration is less than the lower acceleration threshold and the conditions for opening the drinking port 122 are not satisfied. Thus, the container 100 will close or remain closed.

By way of another non-limiting example, a third error state occurs when the user suddenly drops the container 100 while drinking. Thus, the container 100 starts out in the drinking state (block 660). Then, the accelerometer 540 senses the acceleration is less than the lower acceleration threshold and the microcontroller 520 transitions to the unknown state (block 610) and closes the drinking port 122.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A beverage container comprising:

a vessel configured to hold a liquid, the vessel having an opening; and a lid assembly coupled to and closing the opening of the vessel, the lid assembly having a drinking port, a plunger member, and a drive assembly, the drive assembly being configured to move the plunger member between closed and open positions with respect to the drinking port, the drinking port being closed by the plunger member when the plunger member is in the closed position, the drinking port being configured to allow the liquid to flow therethrough when the plunger member is in the open position, the drive assembly comprising drive circuitry, the drive circuitry comprising an inertial measurement unit connected to a microcontroller, the inertial measurement unit comprising a gyroscope and an accelerometer, the inertial measurement unit sending data collected by both the gyroscope and the accelerometer to the microcontroller, the microcontroller obtaining, from the data, a pitch angle of rotation about a pitch axis, a rate of rotation about the pitch axis, and a total acceleration value, the microcontroller being configured to detect the beverage container is in a drinking position when (a) the pitch angle of rotation is between a pitch lower angle threshold and a pitch upper angle threshold for at least a predetermined time period, (b) the total acceleration value is less than or equal to an upper acceleration threshold, and (c) the total acceleration value is greater than or equal to a lower acceleration threshold, the drive circuitry being configured to automatically direct the drive assembly to move the plunger member to the open position when the microcontroller detects the beverage container is in the drinking position, the drive circuitry being configured to automatically direct the drive assembly to move the plunger member to the closed position when the microcontroller detects the beverage container is in other than the drinking position.

2. The beverage container of claim 1, wherein the pitch lower angle threshold is about 20 degrees, the pitch upper angle threshold is about 180 degrees, the lower acceleration threshold is about 0.5 G, the upper acceleration threshold is about 1.5 G, and the predetermined time period is about 2 seconds.

3. The beverage container of claim 1, wherein the microcontroller obtains, from the data, a roll angle of rotation about a roll axis, and the microcontroller is configured to detect the beverage container is in other than the drinking position when the roll angle of rotation is greater than a roll upper angle threshold, the pitch angle of rotation is less than the pitch lower angle threshold, or the total acceleration value is between the upper and lower acceleration thresholds.

4. The beverage container of claim 3, wherein the roll upper angle threshold is about 45 degrees, the pitch lower angle threshold is about 20 degrees, the lower acceleration threshold is about 0.5 G, and the upper acceleration threshold is about 1.5 G.

5. The beverage container of claim 3, wherein the microcontroller is configured to detect the beverage container is in an upright position when the roll angle of rotation is less than a roll lower angle threshold, the pitch angle of rotation is less than the pitch lower angle threshold, and the total acceleration value is between the upper and lower acceleration thresholds, and the drive circuitry is configured to direct the drive assembly to move the plunger member to the closed position when the microcontroller detects the beverage container is in the upright position.

6. The beverage container of claim 5, wherein the roll lower angle threshold is about 20 degrees, the pitch lower angle threshold is about 20 degrees, the lower acceleration threshold is about 0.5 G, and the upper acceleration threshold is about 1.5 G.

7. The beverage container of claim 1, further comprising:

a cam member abutting the plunger member, the drive assembly further comprising a motor operable to rotate the cam member, the motor being connected to the drive circuitry, the drive circuitry being configured to automatically direct the motor to rotate the cam member in a first direction when the microcontroller detects the beverage container is in the drinking position and to rotate the cam member in a second direction when the microcontroller detects the beverage container is in other than the drinking position, the second direction being opposite the first direction, the cam member pushing on the plunger member and moving the plunger member toward the open position when the motor rotates the cam member in the first direction.

8. The beverage container of claim 7, further comprising:

at least one biasing member that biases the plunger member toward the closed position, the cam member allowing the at least one biasing member to move the plunger member toward the closed position when the motor rotates the cam member in the second direction.

9. The beverage container of claim 1, further comprising:

a vent seal coupled to and movable with the plunger member between the closed and open positions, the lid assembly comprising a vent aperture, the vent seal allowing gas to flow from inside the vessel and out through the vent aperture when the plunger member is in the open position, the vent seal preventing the gas from flowing through the vent aperture when the plunger member is in the closed position.

10. The beverage container of claim 1, further comprising:

an electrical power source configured to provide power to the drive circuitry, the drive circuitry further comprising a solenoid operable to move the plunger member between the closed and open positions with respect to the drinking port.

11. The beverage container of claim 1, further comprising:

an electrical power source configured to provide power to the drive assembly, the drive assembly further comprising a motor operable to move the plunger member between the closed and open positions with respect to the drinking port.

12. A lid assembly configured to close an opening in a vessel holding a liquid, the lid assembly comprising:

a drinking port configured to be in fluid communication with the liquid when the lid assembly is closing the opening in the vessel;

a plunger member moveable between closed and open positions with respect to the drinking port, the plunger member being configured to prevent the liquid from flowing through the drinking port when the plunger member is in the closed position, the plunger member being configured to allow the liquid to flow through the drinking port when the plunger member is in the open position; and a drive assembly configured to move the plunger member between the closed and open positions with respect to the drinking port, the drive assembly comprising drive circuitry, the drive circuitry comprising an inertial measurement unit connected to a microcontroller, the microcontroller being configured to detect when the lid assembly is in a drinking position and when the lid assembly is in other than the drinking position, the inertial measurement unit comprising a gyroscope and an accelerometer, the inertial measurement unit sending data collected by both the gyroscope and the accelerometer to the microcontroller, the microcontroller obtaining, from the data, a pitch angle of rotation about a pitch axis, a rate of rotation about the pitch axis, and a total acceleration value, the microcontroller being configured to detect the lid assembly is in the drinking position when (a) the pitch angle of rotation is between a pitch lower angle threshold and a pitch upper angle threshold for at least a predetermined time period, (b) the total acceleration value is less than or equal to an upper acceleration threshold, and (c) the total acceleration value is greater than or equal to a lower acceleration threshold, the drive circuitry being configured to automatically direct the drive assembly to move the plunger member to the open position when the microcontroller detects the lid assembly is in the drinking position, the drive circuitry being configured to automatically direct the drive assembly to move the plunger member to the closed position when the microcontroller detects the lid assembly is in other than the drinking position.

13. The lid assembly of claim 12, wherein the pitch lower angle threshold is about 20 degrees, the pitch upper angle threshold is about 180 degrees, the lower acceleration threshold is about 0.5 G, the upper acceleration threshold is about 1.5 G, and the predetermined time period is about 2 seconds.

14. The lid assembly of claim 12, wherein the microcontroller obtains, from the data, a roll angle of rotation about a roll axis, and the microcontroller is configured to detect the lid assembly is in other than the drinking position when the roll angle of rotation is greater than a roll upper angle threshold, the pitch angle of rotation is less than the pitch lower angle threshold, or the total acceleration value is between the upper and lower acceleration thresholds.

15. The lid assembly of claim 14, wherein the roll upper angle threshold is about 45 degrees, the pitch lower angle threshold is about 20 degrees, the lower acceleration threshold is about 0.5 G, and the upper acceleration threshold is about 1.5 G.

16. The lid assembly of claim 14, wherein the microcontroller is configured to detect the lid assembly is in an upright position when the roll angle of rotation is less than a roll lower angle threshold, the pitch angle of rotation is less than the pitch lower angle threshold, and the total acceleration value is between the upper and lower acceleration thresholds, and the drive circuitry is configured to direct the drive assembly to move the plunger member to the closed position when the microcontroller detects the lid assembly is in the upright position.

17. The lid assembly of claim 16, wherein the roll lower angle threshold is about 20 degrees, the pitch lower angle threshold is about 20 degrees, the lower acceleration threshold is about 0.5 G, and the upper acceleration threshold is about 1.5 G.

18. The lid assembly of claim 12, further comprising:

a cam member abutting the plunger member, the drive assembly further comprising a motor operable to rotate the cam member, the motor being connected to the drive circuitry, the drive circuitry being configured to automatically direct the motor to rotate the cam member in a first direction when the microcontroller detects the lid assembly is in the drinking position and to rotate the cam member in a second direction when the microcontroller detects the lid assembly is in other than the drinking position, the second direction being opposite the first direction, the cam member pushing on the plunger member and moving the plunger member toward the open position when the motor rotates the cam member in the first direction.

19. The lid assembly of claim 18, further comprising:

at least one biasing member that biases the plunger member toward the closed position, the cam member allowing the at least one biasing member to move the plunger member toward the closed position when the motor rotates the cam member in the second direction.

20. The lid assembly of claim 12, further comprising:

a vent seal coupled to and movable with the plunger member between the closed and open positions, the lid assembly comprising a vent aperture, the vent seal allowing gas to flow from inside the vessel and out through the vent aperture when the plunger member is in the open position, the vent seal preventing the gas from flowing through the vent aperture when the plunger member is in the closed position.

21. The lid assembly of claim 12, further comprising:

an electrical power source configured to provide power to the drive assembly, the drive circuitry further comprising a solenoid operable to move the plunger member between the closed and open positions with respect to the drinking port.

22. The lid assembly of claim 12, further comprising:

an electrical power source configured to provide power to the drive assembly, the drive assembly further comprising a motor operable to move the plunger member between the closed and open positions with respect to the drinking port.

* * * * *